US009347648B2

(12) United States Patent
Ng et al.

(10) Patent No.: US 9,347,648 B2
(45) Date of Patent: May 24, 2016

(54) LIGHTING APPARATUS WITH TRANSMISSION CONTROL

(71) Applicant: Avago Technologies General IP (Singapore) Pte. Ltd., Sinapore (SG)

(72) Inventors: Fook Chuin Ng, Butterworth (MY); Choon Guan Ko, Penang (MY); Lig Yi Yong, Penang (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 323 days.

(21) Appl. No.: 14/012,758

(22) Filed: Aug. 28, 2013

(65) Prior Publication Data

US 2015/0062907 A1 Mar. 5, 2015

(51) Int. Cl.

| | |
|---|---|
| ***F21V 9/10*** | (2006.01) |
| ***F21K 99/00*** | (2010.01) |
| ***F21V 9/16*** | (2006.01) |
| ***F21V 14/00*** | (2006.01) |
| *F21Y 101/02* | (2006.01) |

(52) U.S. Cl.

CPC ... *F21V 9/10* (2013.01); *F21K 9/56* (2013.01); *F21K 9/58* (2013.01); *F21V 9/16* (2013.01); *F21V 14/003* (2013.01); *F21Y 2101/02* (2013.01)

(58) Field of Classification Search

CPC ..... F21V 9/10; F21K 9/56

See application file for complete search history.

(56) References Cited

U.S. PATENT DOCUMENTS

| | | | | |
|---|---|---|---|---|
| 6,883,926 | B2 | 4/2005 | Wojnarowski | |
| 7,248,310 | B2 | 7/2007 | Mueller-Mach et al. | |
| 8,203,260 | B2 | 6/2012 | Li et al. | |
| 8,284,152 | B1 | 10/2012 | Lew et al. | |
| 2009/0147497 | A1 * | 6/2009 | Nada | G02B 6/0023 362/84 |
| 2012/0091912 | A1 | 4/2012 | Brown Elliott | |

* cited by examiner

*Primary Examiner* — Elmito Breval

(57) ABSTRACT

A lighting apparatus having a light source, a wavelength converter, a transmission adjustor and a circuit is disclosed. The transmission adjustor is optically coupled between the light source and the wavelength converter to control an amount of light from the first light source entering the wavelength converter. In another embodiment, a lighting apparatus with a light source, first and second wavelength converters, first and second transmission attenuators, and a circuit is disclosed. The color point of the lighting apparatus is controlled through the first and second transmission attenuators. In yet another embodiment, a lighting fixture having a body with an aperture, a light source, a first transmission adjustor, and a wavelength converter is disclosed. The lighting fixture may have an additional aperture with additional wavelength converter and additional transmission adjustor.

20 Claims, 17 Drawing Sheets

LIGHTING APPARATUS WITH TRANSMISSION CONTROL

BACKGROUND

A light-emitting diode (referred to hereinafter as LED) represents one of the most popular light-emitting devices today. In recent years, the luminous efficacy of LEDs, defined in lumens per Watt, has increased significantly from 20 lumens per Watt (approximately the luminous efficacy of an incandescent light bulb) to over 400 lumens per Watt, which greatly exceeds the luminous efficacy of a fluorescent light at 60 lumens per Watt. In other words, for a fixed amount of light output, LEDs consume approximately one sixth of the power compared to fluorescent lights, and almost negligibly small compared to incandescent light bulbs. Accordingly, it is not surprising today that lighting fixtures with LEDs have recently been replacing incandescent light bulbs and fluorescent light tubes. A new term "Solid-State Lighting" has been created. The term "Solid-State Lighting" refers to the type of lighting that uses semiconductor light-emitting diodes, such as an LED rather than traditional light sources.

In the field of solid-state lighting, most of the light sources are white light. The white light sources used in solid-state lighting may be further categorized by color temperature. The color temperature of a light source indicates the relative color appearance of the particular light source on a scale from "warmer" (more yellow/amber) to "cooler" (more blue) light. Color temperatures are generally given in Kelvin or K. Color temperatures over 5,000K are called cool colors (bluish white), while lower color temperatures (2,700-3,000 K) are called warm colors (yellowish white through red).

However, white solid-state light sources made from LEDs may be susceptible to process variation and other effects due to variation in manufacturing process. In many circumstances, white light sources are packaged LEDs with phosphor coated directly on the light source die. The phosphor layers are usually premixed and may not be have a consistent size and deposition. In addition, the phosphor directly coated on the light source die within the same packaging may be susceptible to high temperature when the light source die is turned on. With the reasons discussed above and some other process related issues, color point of white light solid state light sources made from packaged LEDs may be difficult to control and thus, process variation may be huge. The color point of the LEDs may vary substantially even using the same equipment and the same material. The variation may be to the extent that products produced at the same time using the same equipment are noticeably different in terms of color point or brightness.

Generally, one solution to the process variation issue may be by binning the products in accordance to the color temperature and the brightness of the LEDs so that products with similar brightness and color temperature can be separated and assembled together into each individual lighting fixture. The binning process may cause significant production yield loss especially when the process variation is huge. From lighting fixture manufacturer's perspective, the binning is not desirable. In order to fulfill the market needs of a wide range of color temperature ranging from warm white lighting fixtures to cool white lighting fixtures, lighting fixture manufacturers may have to manage significant inventories. For example, if the manufacturer uses 10 color bins, he may need to stock up to ten times inventories compared to ordinary manufacturing method without binning. The binning process may not be cost effective, and the cost will be eventually transferred to consumers.

BRIEF DESCRIPTION OF THE DRAWINGS

Illustrative embodiments by way of examples, not by way of limitation, are illustrated in the drawings. Throughout the description and drawings, similar reference numbers may be used to identify similar elements. The drawings are for illustrative purpose to assist understanding and may not be drawn per actual scale.

DETAILED DESCRIPTION

Figure 1:
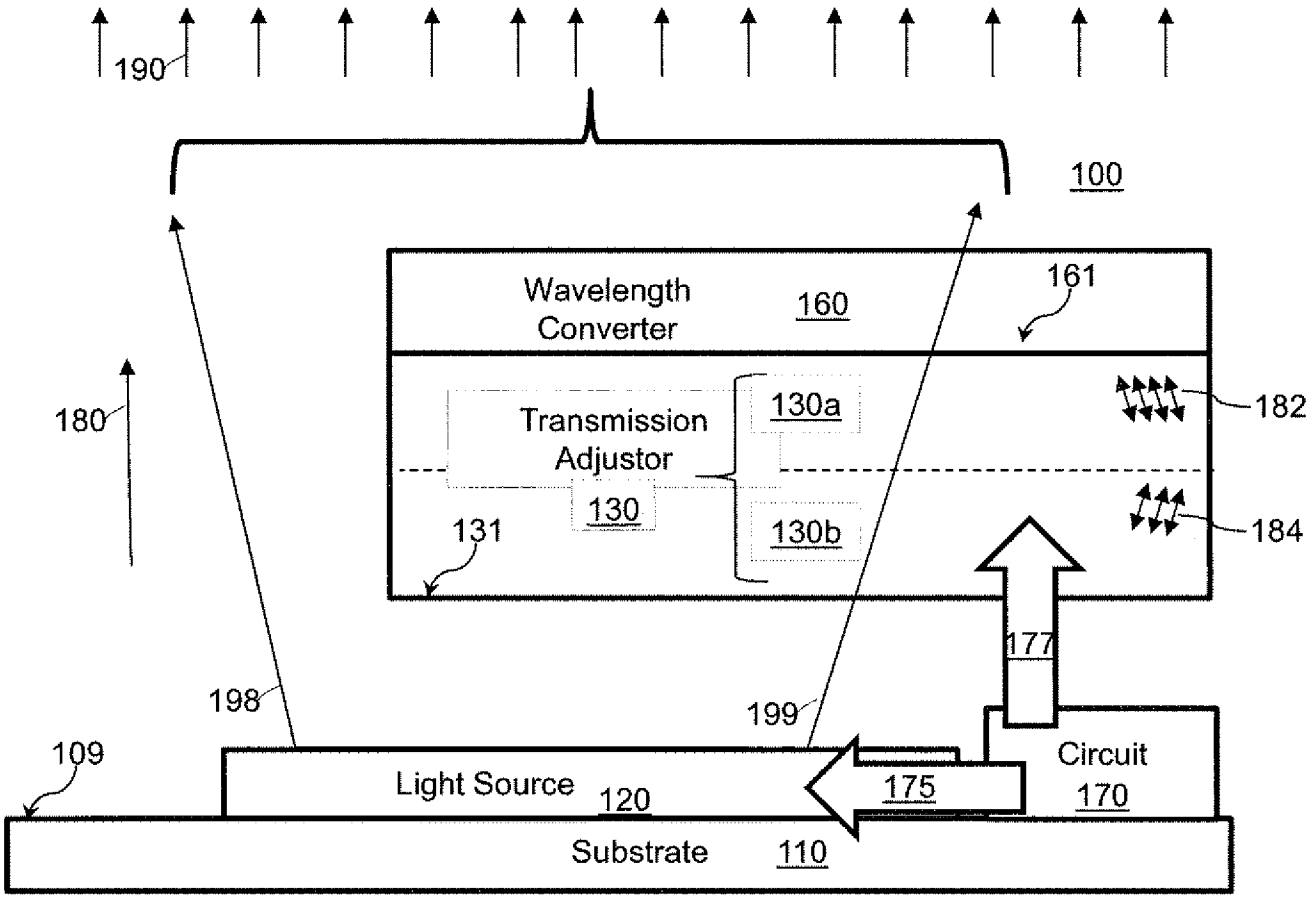
FIG. 1 shows an illustrative view of a lighting apparatus comprising a transmission adjustor.

FIG. 1 shows an illustrative view of a lighting apparatus 100 for producing a light output 190. The lighting apparatus 100 may comprise a substrate 110, a light source 120, a transmission adjustor 130, a wavelength converter 160 and a circuit 170. The substrate 110 may be a printed circuit board (referred hereinafter as "PCB"), or a lead-frame casted structure for receiving the light source 120. In one embodiment, the substrate 110 may be a portion of a body of the lighting apparatus 100.

The light source 120 may be a packaged LED, a bare LED die soldered on the substrate 110, or any other devices that is configurable to emit light. The term "light" may include both visible and non-visible light and any other electromagnetic radiation such as, but not limited to, ultra violet or infra red light or any other radiation of other wavelengths. The term "light" may be narrowly interpreted as only a specific type of electromagnetic wave but in this specification, all possible variations of electromagnetic waves should be taken into consideration when a specific type of light or radiation is discussed unless explicitly expressed otherwise. For example, ultra-violet, infrared and other invisible radiation should be included when considering the term "light" although literally light means radiation that is visible to the human eye.

The light source 120 may be disposed on the substrate 110 and configured to emit a radiation 198, 199 having a source wavelength band. For example, in one embodiment, the light source 120 may be a blue LED configured to emit a radiation having a source wavelength band approximately around 380 nm. In another embodiment, the light source 120 may be a ultra-violet die configured to emit ultra violet radiation having a source wavelength band peaking at approximately 310 nm. In yet another embodiment, the light source 120 may be a green LED configured to emit a radiation having a source wavelength band approximately around 520 nm.

In the illustrative view of a block diagram shown in FIG. 1, the "light source" 120 is represented using a block. The block may not represent the actual number of the light source 120. There may be one or more than one light source 120 in the lighting apparatus 100. In addition, there may be more than one type of light source 120. For example, the light source 120 may comprise at least one packaged blue LED and at least one red green blue (RGB) LED in one embodiment. The light source 120 may be driven by a drive current 175 from the circuit 170. In this way, the light source 120 may be controlled using the circuit 170.

The lighting apparatus 100 may be configured to produce the light output 190 towards a predetermined output direction 180. As shown in FIG. 1, the substrate 110 may further comprise an inner surface 109 facing the output direction 180. The inner surface 109 may be configured to accommodate the light source 120 and may be reflective so as to reflect light towards the output direction 180. As shown in FIG. 1, the light source 120 may be disposed on the inner surface 109 of the substrate 110.

The transmission adjustor 130 may be formed adjacent to but distanced away from the light source 120 allowing the light from the light source 120 to be mixed prior to entering the transmission adjustor 130. The transmission adjustor 130 may be configured to adjust the light such as absorbing light, which may be polarized in a specific direction to produce a polarized light. For example, the transmission adjustor 130 may comprise a first adjustor layer 130*a* configured to produce light polarized in a first polarization direction 182 and a second adjustor layer 130*b* configured to produce light polarized in a second polarization direction 184. The first and second polarization direction 182, 184 may be controllable using the circuit 170.

The transmission adjustor 130 may have a transmissivity that is controllable or adjustable. For example, in the embodiment shown in FIG. 1, in a first state, the transmission adjustor 130 may be substantially transparent as both the first adjustor layer 130*a* and the second adjustor layer 130*b* are configured to produce light polarized in substantially similar direction. In other words, in the first state, the first and second polarization direction 182, 184 may be substantially similar allowing all the light to pass through. In one embodiment, the transmission adjustor 130 may be substantially transparent in the first state with transmissivity approximately between 80% and 100% in the first state.

In a second state, the transmission adjustor 130 may be substantially opaque because the first adjustor layer 130*a* and the second adjustor layer 130*b* may be configured to produce light in a polarization direction substantially orthogonal to each other. In other words, in the second state, the first polarization direction 182 may be substantially orthogonal relative to the second polarization direction 184 cutting off all the light radiation. In one embodiment, the transmission adjustor 130 may be substantially opaque in the second state with the transmissivity approximately between 0% and 20%.

The transmission adjustor 130 may comprise a liquid crystal material, an electro-chromic gel material, or any other material that may block light in one state and to allow light to pass through in another state. The transmission adjustor 130 may be controlled using an electrical signal 177 from the circuit 170. In addition, the circuit 170 may be configured to provide the drive current 175 to drive the light source 120. In one embodiment, the transmissivity of the transmission adjustor 130 may be configured to be substantially linearly proportional to the electrical signal 177 of the circuit 170. In other words, the circuit 170 may be configured to control the transmission adjustor 130 such that the electrical signal 177 of the circuit 170 may be substantially linearly proportional to the transmissivity of the transmission adjustor 130.

As illustrated in FIG. 1, the transmission adjustor 130 may be formed between the light source 120 and the wavelength converter 160 such that the radiation 199 emitted from the light source 120 entering the wavelength converter 160 may be substantially transmitted through the transmission adjustor 130. As the transmissivity of the transmission adjustor 130 may be adjustable in accordance to the electrical signal 177 of the circuit 170, the amount of the radiation 199 from the light source 120 entering the wavelength converter 160 may be controlled using the circuit 170.

As shown in FIG. 1, the wavelength converter 160 may comprise a converter surface 161 arranged substantially orthogonal relative to the output direction 180 for receiving the light output from the light source 120. Similarly, the transmission adjustor 130 may comprise an adjustor surface 131 arranged substantially orthogonal relative to the output direction 180 for receiving light output from the light source 120. The converter surface 161 and the adjustor surface 131 may be arranged substantially in parallel relative to each other. In one embodiment, the converter surface 161 may be approximately equal to or smaller than the adjustor surface 131. This arrangement may enable control of the amount of radiation 199 entering the wavelength converter 160 because all the light entering the converter surface 161 may have to enter the adjustor surface 131 first.

Recall that the radiation emitted from the light source 120 may have a predetermined source wavelength band. The wavelength converter 160 may be configured to convert an amount of the radiation 199 from the light source 120 entering the wavelength converter 160 into a converted light that has a first wavelength band broader than the source wavelength band. For example, the wavelength converter 160 may comprise a phosphor material adaptable to convert a narrow band blue or green light from the light source 120 into a broad spectrum white light.

The arrangement of the wavelength converter 160 being distanced away from the light source 120 interposing the transmission adjustor 130 there between may be advantageous. For example, the wavelength converter 160 may be distanced away from the light source 120 that may generate heat and therefore, may be less susceptible to temperature change. In addition, the wavelength converter 160 may be formed more uniformly on a surface of the transmission adjustor 130 or housing of the transmission adjustor 130 compared to conventional method of forming within the packaged LED. In addition, the arrangement enables the amount of the radiation 199 entering the wavelength converter 160 to be controllable as discussed previously herein.

Optionally, a portion of the radiation 198 from the light source 120 may be transmitted externally without passing through the wavelength converter 160. In this case, the light output 190 may comprise the converted light from the radiation 199 and the portion of the radiation 198 emitted from the light source 120 that may be transmitted externally without passing through the wavelength converter 160. For example, in one embodiment, the radiation 198 that is transmitted externally without passing through the wavelength converter 160 may be blue light, whereas the radiation 199 being converted into the wavelength band broader than the source wavelength band may be white light. With this arrangement, the color point of the lighting apparatus 100 may be adjustable by adjusting the amount of white light transmitted out from the lighting apparatus 100 by using the transmission adjustor 130.

Figure 2:
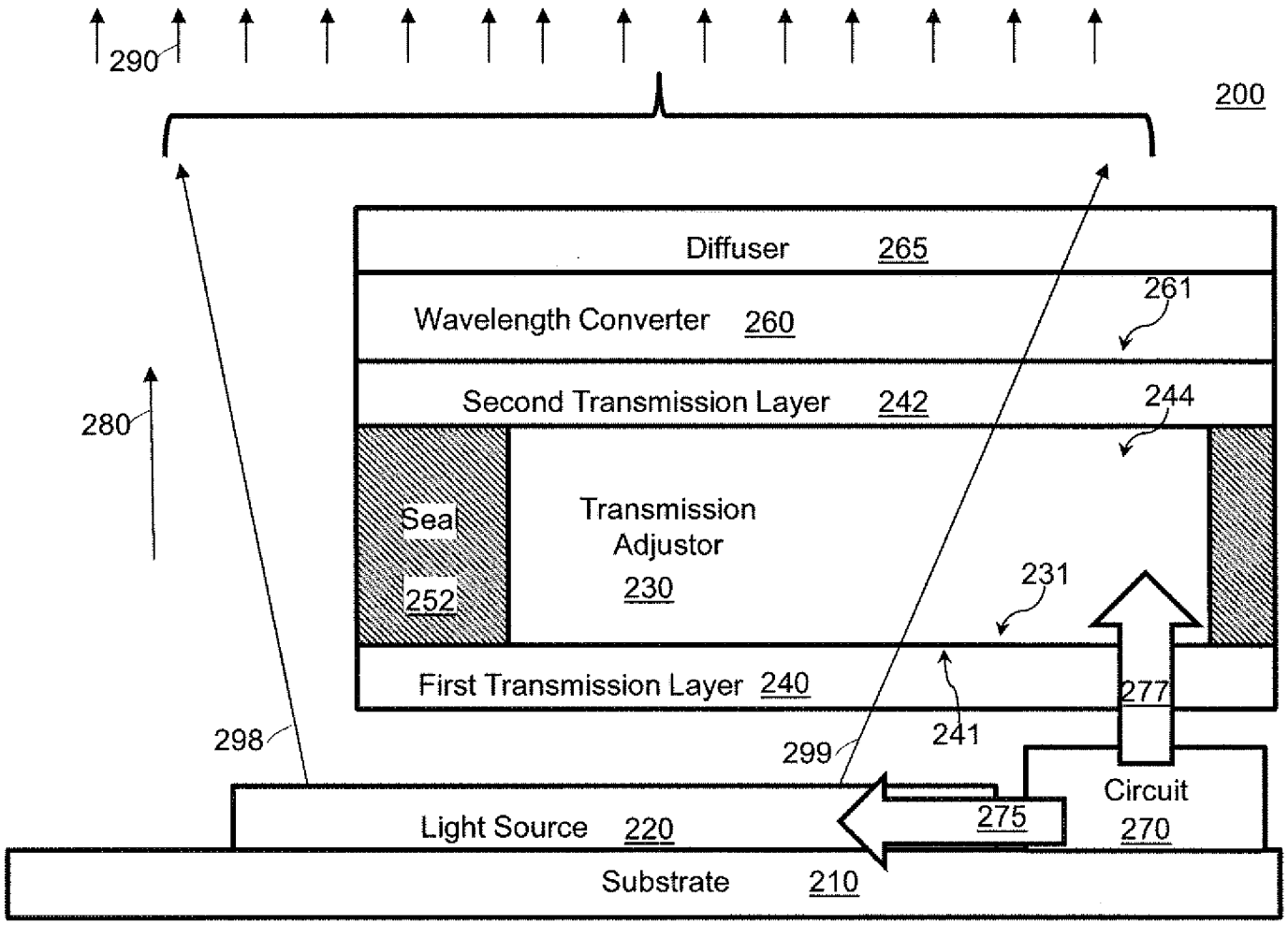
FIG. 2 shows an illustrative view of a lighting apparatus comprising a transmission adjustor sandwiched between first and second transmission layers.

FIG. 2 shows an illustrative view of a lighting apparatus 200 for producing a light output 290 towards an output direction 280. The lighting apparatus 200 may comprise a substrate 210, a light source 220, a transmission adjustor 230, a first transmission layer 240, a second transmission layer 242, a seal 252, a wavelength converter 260, a diffuser 265 and a circuit 270. The lighting apparatus 200 may be similar to the lighting apparatus 100 but differs at least in that the lighting apparatus 200 comprises the diffuser 265, the seal 252, the first and second transmission layers 240, 242.

As shown in FIG. 2, the transmission adjustor 230 may be sandwiched between the first and second transmission layers 240, 242. In addition, the second transmission layer 242 may be in turn sandwiched between the transmission adjustor 230 and the wavelength converter 260. The entire structure of the first and second transmission layers 240, 242, and the transmission adjustor 230 may be sandwiched between the wavelength converter 260 and the light source 220. In other words, the wavelength converter 260 and the light source 220 may be arranged interposing the first transmission layer 240, the transmission adjustor 230 and the second transmission layer 242. With this arrangement, the light emitted from the light source 220 may be entering the first and second transmission layers 240, 242 and the transmission adjustor 230 prior to entering the wavelength converter 260. This arrangement may be advantageous for the reason that the amount of light entering the wavelength converter 260 may be made controllable by adjusting the transmission adjustor 230 using the circuit 270.

The first and second transmission layers 240, 242 may be a substantially transparent light guide made from glass, or transparent thermoplastic such as polymethyl methacrylate also referred to as PMMA, or polycarbonate or other similar material suitable to make light guides. In one embodiment, the first and second transmission layers 240, 242 may be substantially transparent permitting more than approximately 95% of light to be transmitted through. In another embodiment, the first and second transmission layers 240, 242 may be configured to diffuse light and may appear whitish but with transmissivity of more than approximately 75%.

In the embodiment shown in FIG. 2, the transmission adjustor 230 may be in liquid or semi liquid form. The lighting apparatus 200 may comprise a seal 252 sandwiched between the first and second transmission layers 240, 242 and define there between a single integrated cavity 244. The transmission adjustor 230 may be formed within the single integrated cavity 244 between the seal 252, the first and second transmission layers 240, 242. As shown in FIG. 2, the perimeter seal 252 may be circumferencing the transmission adjustor 230 such that the transmission adjustor 230 that may be in liquid or semi liquid form may be contained in a fixed form and shape at the specific location.

The first and second transmission layers 240, 242 may extend planarly in a direction substantially orthogonal to the output direction 280 of the lighting apparatus 200. As shown in FIG. 2, the first transmission layer 240 has a major surface 241. The major surface 241 may be a substantially flat internal surface 241 intercepting a substantial amount of light traveling towards the output direction 280. In one embodiment, more than approximately eighty percent of the major surface 241 may be in direct contact with the single integrated cavity 244 and thus, intercepting substantial portion of light passing through the first transmission layer 240.

The major surface 241 of the first transmission layer 240 may be in direct contact with an adjustor surface 231 of the transmission adjustor 230. The adjustor surface 231 may be about the same size or slightly smaller than the major surface 241. In the embodiment shown in FIG. 2, the adjustor surface 231 may be approximately less than 95% of the major surface 241. The sizing selection shown in FIG. 2 may be advantageous for accommodating the seal 252 while maximizing exposure of the adjustor surface 231 of the transmission adjustor 230.

The wavelength converter 260 may be formed as a substantially thin layer adjacent to the second transmission layer 242. In the embodiment shown in FIG. 2, the wavelength converter 260 may be in direct contact with the second transmission layer 242 as the wavelength converter 260 may be formed on the second transmission layer 242. This arrangement may be advantageous for enabling the wavelength converter 260 to be formed uniformly on the second transmission layer 242. The second transmission layer 242 may be substantially flat and thus, depositing a thin layer of wavelength converter 260 on the second transmission layer may be more controllable and may be easier compared to depositing the wavelength converter 260 at other structure that may not be flat.

A diffuser 265 may be assembled adjacent to the wavelength converter 260 so as a uniform light output 290 may be obtained. Similar to the embodiment shown in FIG. 1, the light output 290 may comprise a converted light portion 299 having been transmitted through the transmission adjustor 230 and the wavelength converter 260, and a non-converted light portion 298 emitted from the light source 220 without being converted by the wavelength converter 260. Similarly, the circuit 270 may be configured to drive the light source 220 with a substantially constant current 275 and may be configured to generate an electrical signal 277 indicative of the transmissivity of the transmission adjustor 230.

Figure 3A:
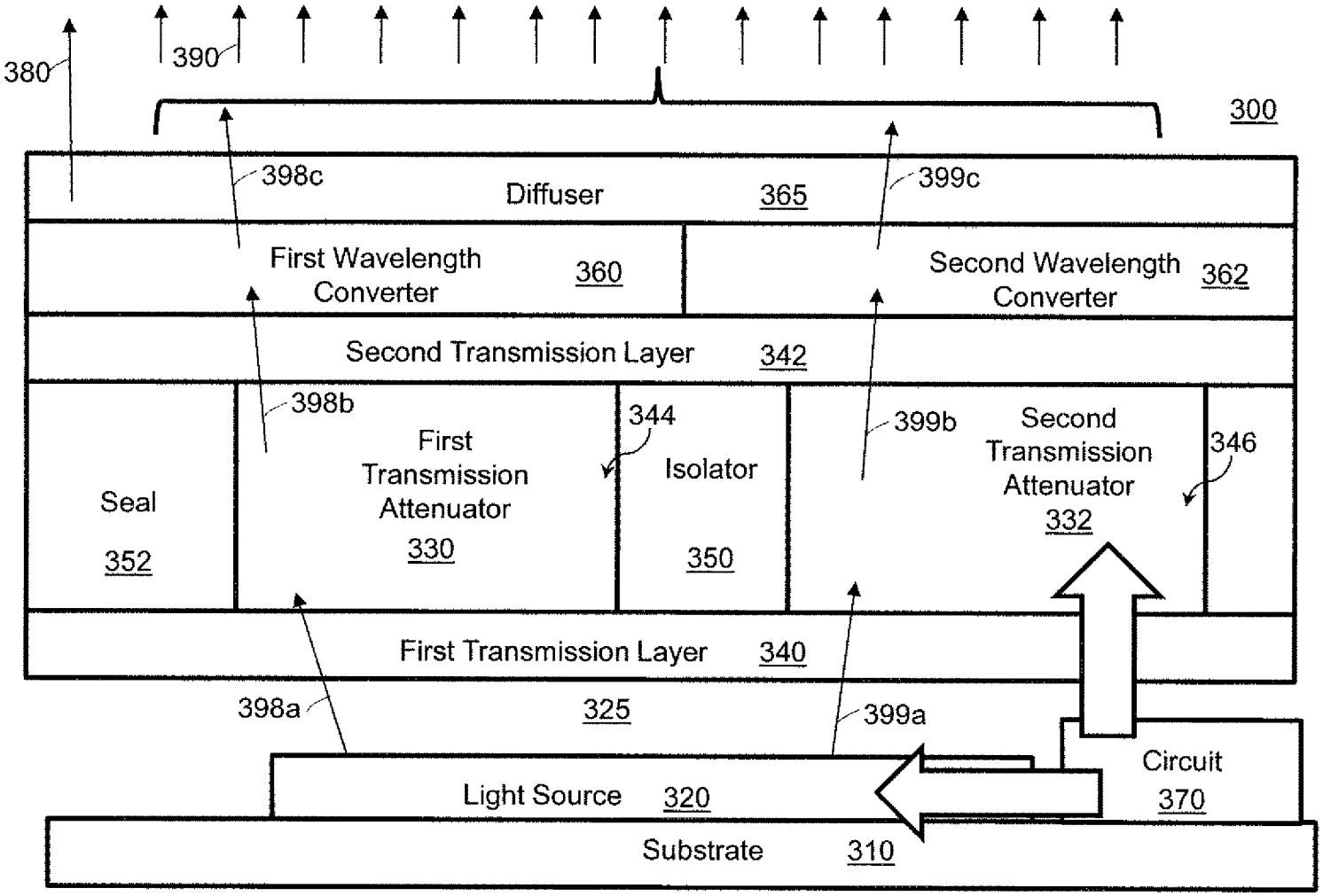
FIG. 3A shows an illustrative view of a lighting apparatus comprising first and second transmission attenuators.

FIG. 3A shows an illustrative view of a lighting apparatus 300 for producing a light output 390. The lighting apparatus 300 may comprise a substrate 310, a light source 320, a first transmission layer 340, a second transmission layer 342, a first transmission attenuator 330, a second transmission attenuator 332, a seal 352, an isolator 350, a first wavelength converter 360, a second wavelength converter 362, an optional diffuser 365 and a circuit 370. The lighting apparatus 300 may be substantially similar to the lighting apparatus 200 but may differ at least in that the lighting apparatus 300 comprise two wavelength converters 360, 362. The lighting apparatus 300 may be configured to produce a light output 390 illuminating towards an output direction 380.

Figure 3B:
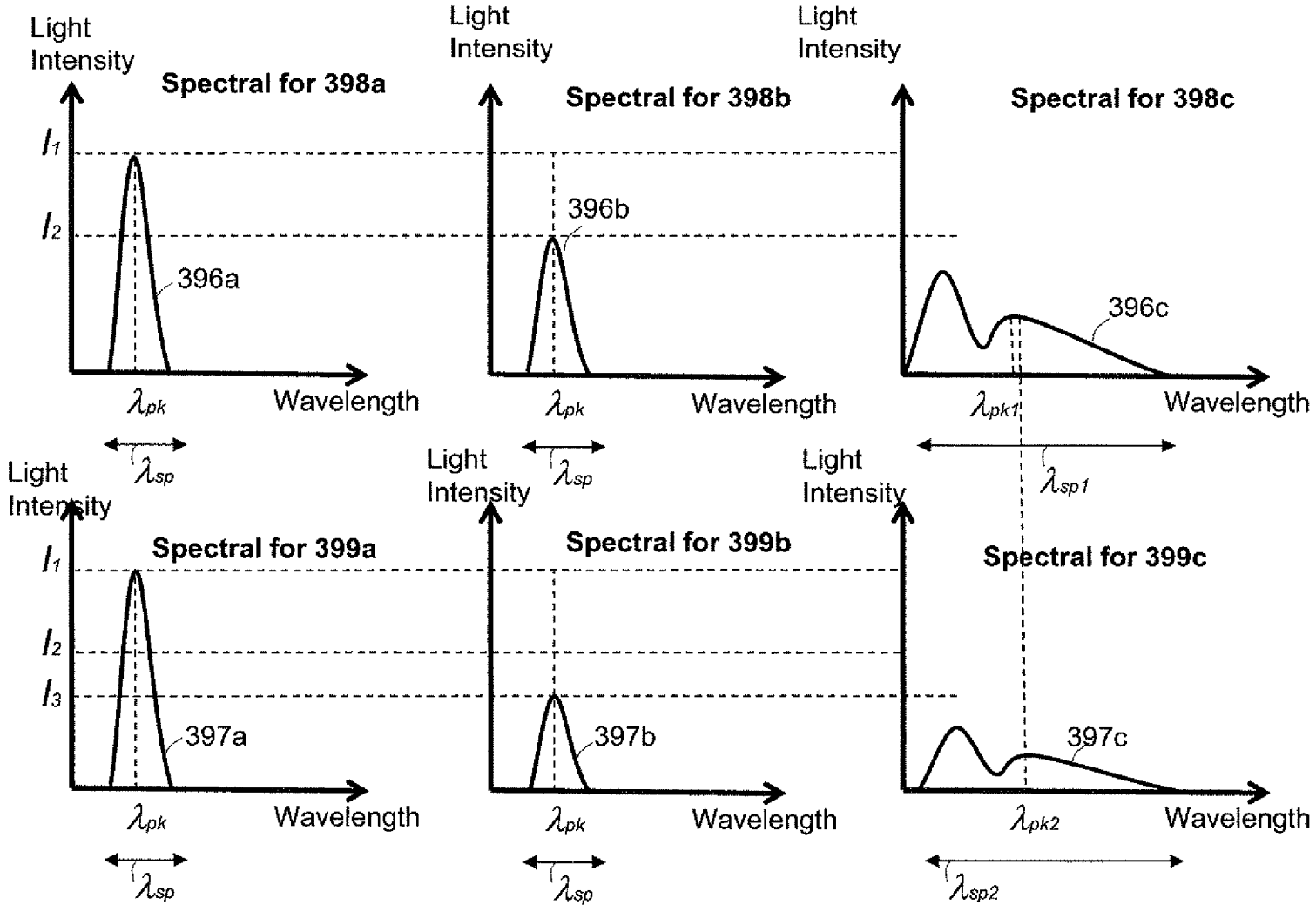
FIG. 3B illustrates spectral graphs of source wavelengths and converted wavelengths.

Referring to FIG. 3A and FIG. 3B, the light source 320 may be configured to emit light illustrated by the light ray 398*a* and the light ray 399*a*. The light rays 398*a*, 399*a* may be visible light with a specific color having a colored narrow band light, or alternatively may be invisible light such as ultra violet. Spectral of the light ray 398*a* and light ray 399*a* may be substantially similar to the graphs illustrated in FIG. 3B respectively. Referring to FIG. 3B, all graphs showing spectral wavelength as horizontal axes and spectral intensity ("I") as vertical axes. In the embodiment shown in FIG. 3A, the light rays 398*a* and 399*a* may be substantially similar. For example, the spectral graph 396*a* of light ray 398*a* may have a source wavelength band $\lambda_{sp}$ peaking at a wavelength $\lambda_{pk}$ with maximum intensity of $I_1$. Similarly, the spectral graph 397*a* of the light ray 399*a* may have a source wavelength band having a source wavelength band $\lambda_{sp}$ peaking at the wavelength $\lambda_{pk}$ with maximum intensity of $I_1$ that may be substantially similar to the spectral graph 396*a* of the light ray 398*a*.

The light rays 398*a*, 399*a* emitted from the light source 320 may be transmitted through the first transmission layer 340 that may be substantially transparent without material light lost. The first and second transmission attenuators 330, 332 may be configured to attenuate the light intensity in accordance to the circuit 370. In other words, each of the first and second transmission attenuators 330, 332 may have a transmissivity that is controllable or adjustable.

For example, comparison between the spectral graph 396*a* of the light ray 398*a* prior to entering the first transmission attenuator 330, and the spectral graph 396*b* of the light ray 398*b* after exiting the first transmission attenuator 330 may reveal that the light intensity has been reduced to $I_1$ from $I_2$ as shown in FIG. 3B. Similarly, comparison between the spectral graph 397*a* of the light ray 399*a* prior to entering the second transmission attenuator 332, and the spectral graph 397*b* of the light ray 399*b* exiting the second transmission attenuator 332 may reveal that the light intensity has been reduced from $I_1$ to $I_3$. The circuit 370 may be configured to control to amount of light to be attenuated by the first and second transmission attenuator 330, 332. However, both the spectral graphs 396*b* and 397*b* shows that the wavelength band may remain substantially unchanged with the source wavelength band of $\lambda_{sp}$. Similarly, the peak wavelength may remain substantially similar to the wavelength $\lambda_{pk}$ as emitted from the light source 320.

The first and second wavelength converters 360, 362 may be configured to convert the light rays 398*b*, 399*b* into first and second converted light 398*e*, 399*c* respectively. During the light conversion, the wavelength band of the light rays 398*b*, 399*b* may be broadened. For example, comparison between the spectral graph 396*e* of first converted light 398*c* after conversion, and the spectral graph 396*b* of the light ray 398*b* prior to conversion as illustrated in FIG. 3B reveals that the first converted light 398*c* may have a first converted wavelength band $\lambda_{sp1}$ broader than the source wavelength band $\lambda_{sp}$. In addition, the first converted light 398*c* may have a secondary peak wavelength $\lambda_{pk1}$.

Similarly, comparison between the spectral graph 397*c* of the second converted light 399*c* after conversion, and the spectral graph 397*b* of the light ray 399*b* prior to conversion reveals that the second converted light 399*c* may have a second converted wavelength band $\lambda_{sp2}$ substantially broader than the source wavelength band $\lambda_{sp}$. The second converted light 399*c* may have a secondary peak wavelength $\lambda_{pk2}$ that may be dissimilar to the secondary peak wavelength $\lambda_{pk1}$ of the first converted light 398*c*.

In the embodiment shown in FIG. 3B, the first and second converted wavelength band $\lambda_{sp1}$, $\lambda_{sp2}$ may be substantially broader than the source wavelength band $\lambda_{sp}$ respectively. The first and second converted wavelength band $\lambda_{sp1}$, $\lambda_{sp2}$ may be dissimilar. However, in another embodiment, the first and second converted wavelength band $\lambda_{sp1}$, $\lambda_{sp2}$ may be substantially similar. The peak intensity of the first and second converted light 398*c*, 399*c* may be lower compared to the peak prior to conversion as shown in FIG. 3B because a portion of the light at the wavelength $\lambda_{pk}$ may have been converted.

In summary, the first wavelength converter 360 may be configured to convert the light ray 398*a* from the light source 320 having the source wavelength band $\lambda_{sp}$ into the first converted light 398*c* having the first wavelength band $\lambda_{sp1}$ broader than the source wavelength band $\lambda_{sp}$, whereas the second wavelength converter 362 may be configured to convert the light ray 399*a* having the source wavelength band $\lambda_{sp}$ into the second converted light 399*c* from the light source 320 having the second wavelength band $\lambda_{sp2}$ broader than the source wavelength band $\lambda_{sp}$.

Similarly, the first transmission attenuator 330 may be optically coupled to the light source 320 in order to control a first amount of the light ray 398*b* from the light source 320 entering the first wavelength converter 360 whereas the second transmission attenuator 322 may be optically coupled to the light source 320 in order to control a second amount of the light ray 399*b* from the light source 320 entering the second wavelength converter 362. In order to allow the first and second transmission attenuators 330, 332 to control light independently, the isolator 350 may be configured to optically isolate the first and second transmission attenuators 330, 332.

The lighting apparatus 300 may be substantially similar to the lighting apparatus 200 shown in FIG. 2 but may differ at least in that lighting apparatus 300 may comprise two types of the first and second wavelength converters 360, 362 instead of a single type. In addition, the first and second transmission attenuators 330, 332 may be configured to attenuate light without modifying spectral contents of the light. In the embodiment shown in FIG. 3A, the first and second transmission attenuators 330, 332 may comprise an electro-chromic gel material.

The first and second transmission layers 340, 342 may be substantially transparent. Optionally, the first and second transmission layers 340, 342 may be configured to diffuse light. The first and second transmission layers 340, 342 of the lighting apparatus 300 may interpose the first and second transmission attenuators 330, 332. The seal 352 may be circumferencing the first and second transmission attenuators 330, 332 such that the first and second transmission attenuators 330, 332 are substantially sealed between the seal 352, the first and second transmission layers 340, 342.

Referring to FIG. 3A, the first transmission attenuator 330 may be formed within a first single integrated cavity 344. The first single integrated cavity 344 may be formed surrounded by the first and second transmission layers 340, 341, a portion of the seal 352 and a portion of the isolator 350. Similarly, the second transmission attenuator 332 may be formed within a second single integrated cavity 346. The second single integrated cavity 346 may be formed surrounded by the first and second transmission layers 340, 342, a portion of the seal 352 and a portion of the isolator 350. In addition, it can be observed from FIG. 3A that the isolator 350, the first and second transmission attenuators 330, 332 may be surrounded by the seal 352 and sandwiched between the first and second transmission layers 340, 342.

As shown in FIG. 3A, the first and second transmission attenuators 330, 332, the first and second transmission layers 340, 342 may be distanced away from the light source 320. This arrangement may be advantageous for providing space for light mixing. For example, consider a case with a plurality of light sources 320 having slightly different spectral output, a space 325 may allow for light mixing such that light transmitted through the first and second transmission attenuators 330, 332 may be more uniformed. In order to further improve uniformity, an optional diffuser 365 may be employed. The diffuser 365 may be optically coupled to the first and second wavelength converters 360, 362 such that the first and second converted light 398*c*, 399*c* exiting the first and second wavelength converters 360, 362 may be diffused into the light output 390 of the lighting apparatus 300.

The first and second wavelength converters 360, 362 may in combination intercept all of the light output 390 such that all light exiting the lighting apparatus 300 are transmitted through the first and second wavelength converters 360, 362. Alternatively, similar to the previous embodiments, a portion of light (not shown) from the light source 320 may be configured to be emitted externally to form a portion of the light output 390 of the lighting apparatus 300 without passing through the first and second wavelength converters 360, 362. In the embodiment that the light source 320 is configured to emit a colored narrow band light, the color may be observed externally. However, the light output 390 may have a different color because a substantial portion of the light output 390 may comprise the first and second converted lights 398*c*, 39*c* that have a broader wavelength band with a different color.

Figure 3C:
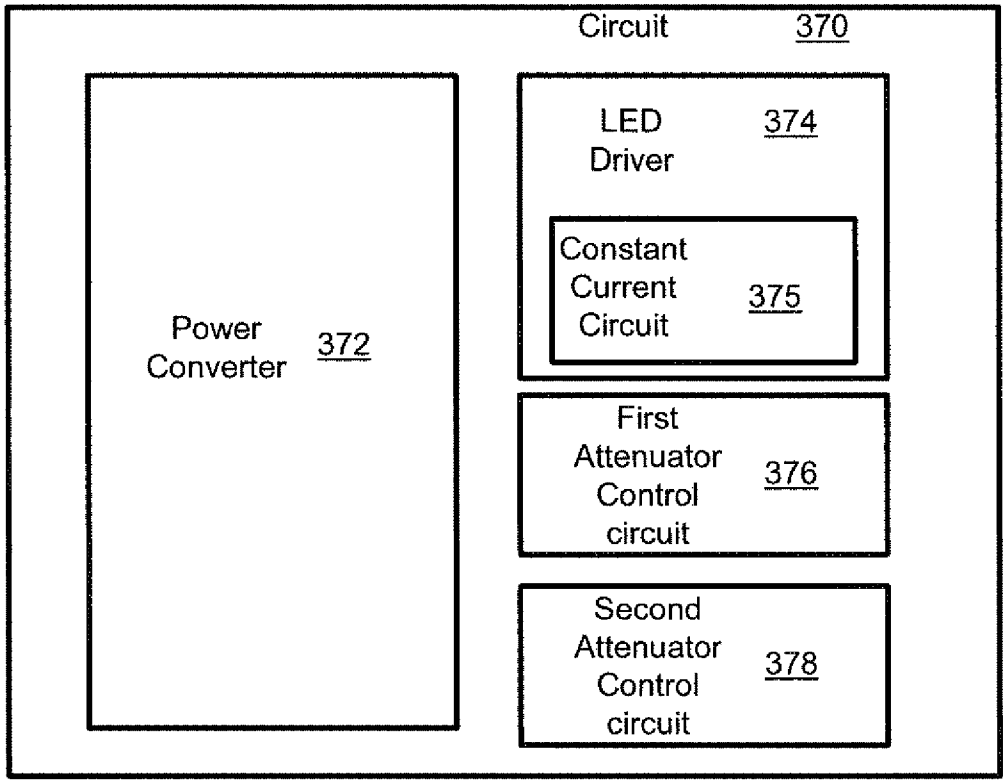
FIG. 3C illustrates a block diagram of the circuit shown in FIG. 3A.

FIG. 3C illustrates a block diagram of the circuit 370 shown in FIG. 3A. As shown in FIG. 3C, the circuit 370 may comprise a power converter 372, an LED driver 374, a first attenuator control circuit 376 and a second attenuator control circuit 378. The circuit 370 may be electrically coupled to the first and second transmission attenuators 330, 332 as well as the light source 320. More specifically, the LED driver 374 may be electrically coupled to the light source 320 for driving the light source 320. The LED driver 374 may comprise a constant current circuit 375 configured to provide a substantially constant current. The first and second attenuator control circuits 376, 378 may be electrically coupled to the first and second transmission attenuators 330, 332 so as to control transmissivity of the first and second transmission attenuators 330, 332 respectively. The power converter 372 may be coupled to the power source for transforming the alternate current of household power supply to a direct current power supply for the electrical components within the lighting apparatus 300.

Figure 3D:
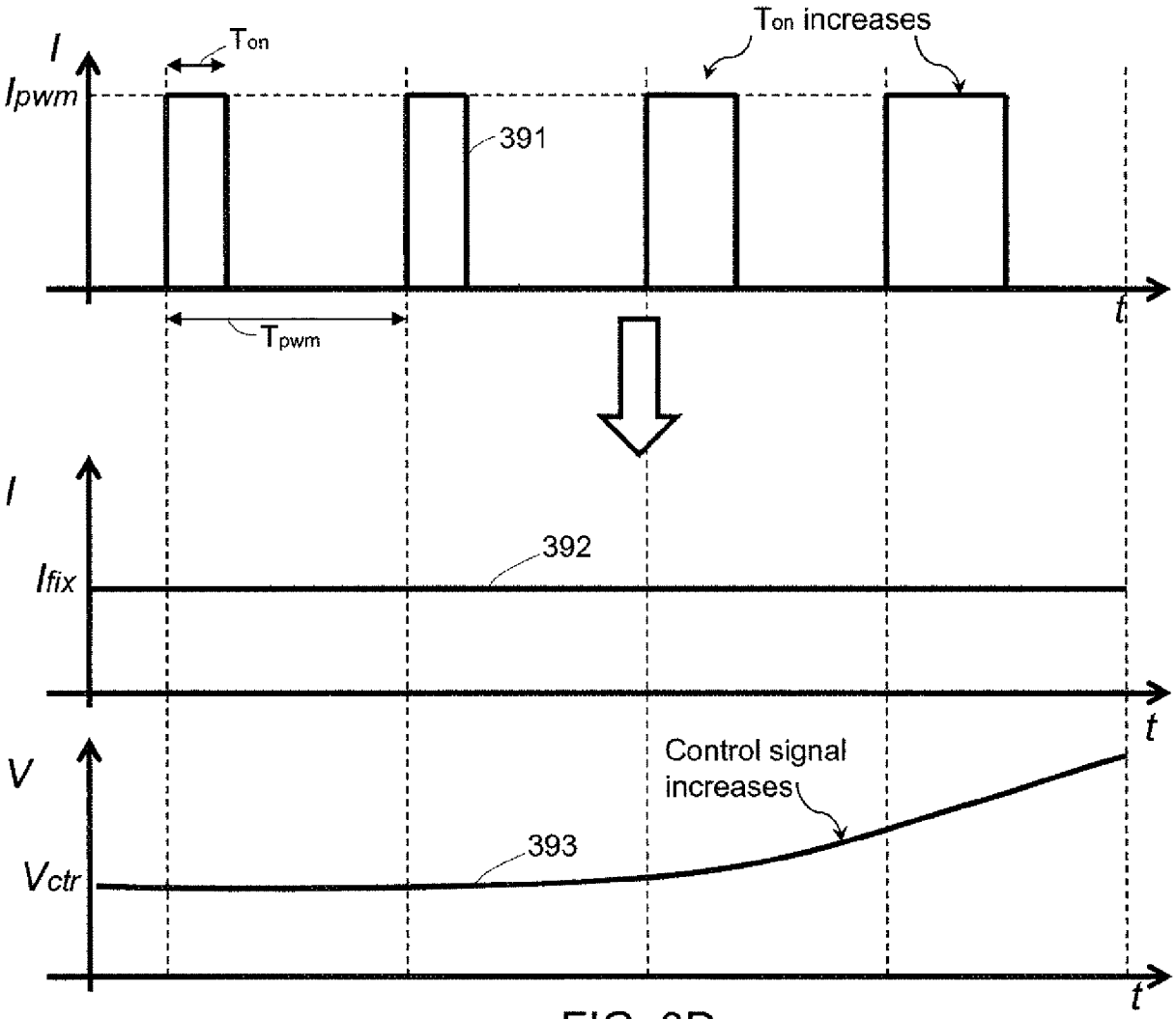
FIG. 3D illustrates various control signals coupled to the light source and the transmission attenuator compared to a conventional pulse width modulation drive signal.

FIG. 3D illustrates various control signals coupled to the light source 320 and the first and second transmission attenuators 330, 332 compared to a conventional pulse width modulation drive signal 391. Vertical axes of the graph shown in FIG. 3D indicate electric current whereas the horizontal axes represent timing of the signals. For conventional pulse width modulation (referred hereinafter as PWM), the modulation drive signal 391 may be turned on for a period of $T_{on}$ in a periodical time cycle of $T_{pwm}$. Depending on the brightness needed, the turn on period $T_{on}$ may be substantially short compared to the periodical time cycle $T_{pwm}$. The effect of "turn on", "turn-off" may cause flickering effect on other home appliances such as computer screens or cameras.

In contrast, the LED driver 374 of the embodiment shown in FIG. 3 may employ a drive signal 392 that may be a substantially constant current $I_{fix}$. During initial stage, the drive signal 392 may be transition from an initial value to the substantially constant current $I_{fix}$. In one embodiment, the substantially constant current $I_{fix}$ may remain constant even though ambient temperature fluctuates significantly from 0° C. to 40° C. More specifically, the value of the substantially constant current $I_{fix}$ may change less than approximately 5% from the initial value. In another embodiment where the LED driver 374 comprise a higher precision constant current circuit 375, the value of the substantially constant current $I_{fix}$ may fluctuate less than approximately 2% within the temperature range between 0° C. to 40° C.

If a higher brightness of the overall lighting apparatus 300 is required, the constant drive current $I_{fix}$ of the drive signal 392 may be adjusted to be higher. Pulse Width Modulation (PWM) may be used. For a fixed amount of brightness, the substantially constant current $I_{fix}$ of the drive signal 392 may be substantially lower compared to the turn on current $I_{pwm}$ of the modulation drive signal 391 of the conventional PWM scheme. This may be because the turn on current $I_{pwm}$ of the conventional PWM scheme is usually turned on for a short period of time rather than continuously as observed in FIG. 3D.

The light passing through the first and second transmission attenuators 330, 332 may be adjusted in accordance to the control signal 393 of the first attenuator control circuit 376. For example, the control signal 393 of the circuit 370 may be linearly proportional to the transmissivity of the first transmission attenuator 330. In the graph shown in FIG. 3D, in order to increase the brightness of a conventional lighting apparatus (not shown), the turn on period $T_{on}$ may be prolonged. This is illustrated by the third and the fourth pulse in the graph.

On the contrary, for the embodiment shown in FIG. 3D, the brightness may be increase by increasing the control signal 393. This is because when the control signal 393 increases, the transmissivity of the first and second transmission attenuators 330, 332 may also increase, thereby allowing more light to be transmitted externally. In another embodiment, a negative signal control scheme may be employed. In other words, when the control signal 393 increases, the transmissivity of the first and second transmission attenuators 330, 332 may decrease accordingly in proportion with the control signal 393.

Referring FIG. 3A, the lighting apparatus 300 may comprise two different types of wavelength converters 360, 362. Thus, by controlling the first and second transmission attenuators 330, 332 separately, the amount of light entering the respective first and second wavelength converters 360, 362 may differs. As a result, light output 390 with different spectral contents may be achieved.

Consider one scenario wherein the first wavelength converter 360 may be a yellow phosphor producing cool white light, and wherein the second wavelength converter 362 may be a red phosphor producing warm white light. By adjusting the amount of light passing through the first and second transmission attenuators 330, 332 using the control signal 393 of the circuit 370, color point of the light output 390 may be adjusted. For example, if the first transmission attenuator 330 may be configured to allow more light to pass through and the second transmission attenuator 332 may be configured to block more light, the color point of the light output 390 may be more similar to the appearance of cool white light. On the contrary, if the arrangement is reversed with the second transmission attenuator 332 allowing more light to pass through compared to the first transmission attenuator 330, the light output 390 may be more similar in appearance to warm white. This arrangement may be beneficial for providing flexibility to control color point of the lighting apparatus 300.

Figure 4A:
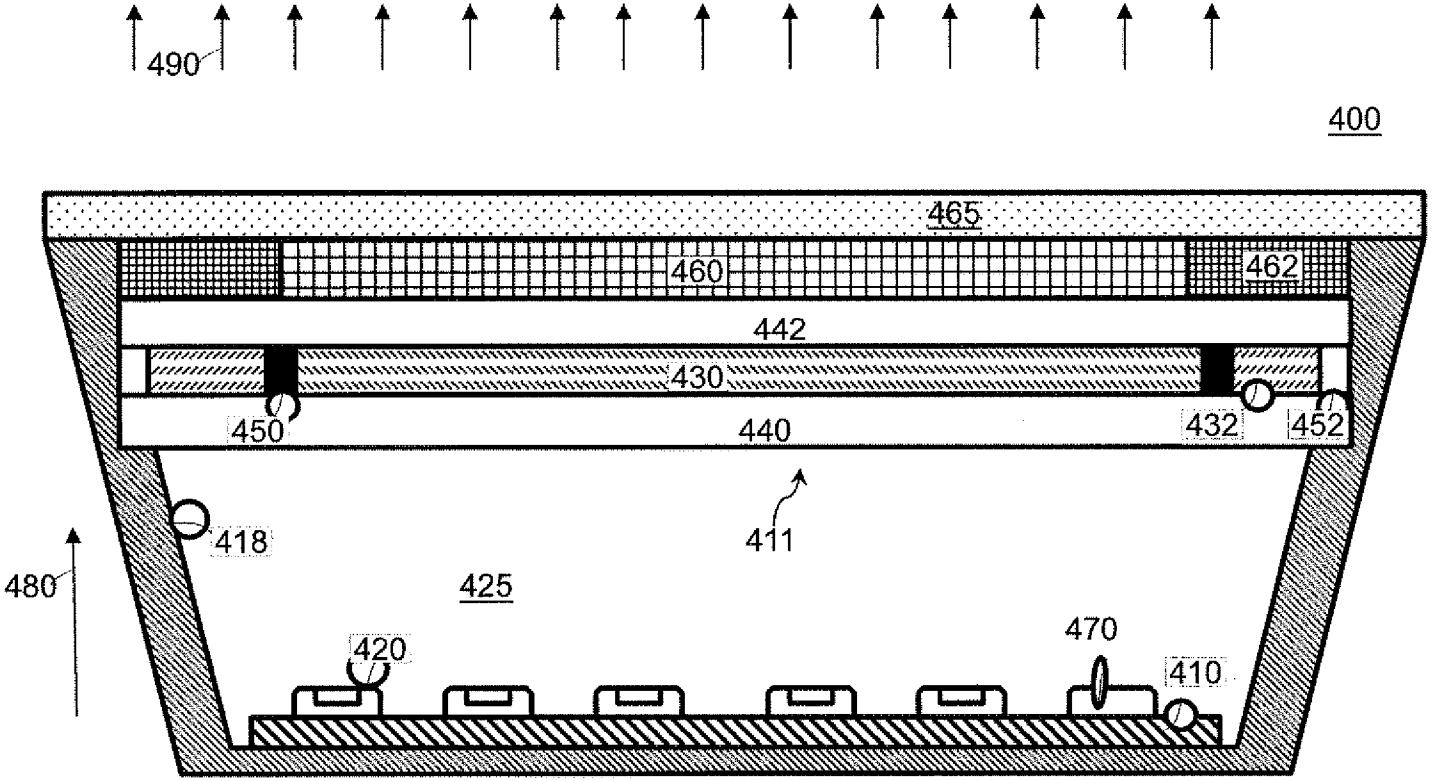
FIG. 4A illustrates a cross-sectional view of a lighting fixture having first and second wavelength converters optically coupled to first and second transmission adjustors respectively.

FIG. 4A illustrates a cross-sectional view of a lighting fixture 400. The lighting fixture 400 may comprise a body 418, an optional substrate 410, a light source 420, a first transmission layer 440, a second transmission layer 442, a first transmission adjustor 430, a second transmission adjustor 432, a seal 452, an isolator 450, a first wavelength converter 460, a second wavelength converter 462, an optional diffuser 465 and a circuit 470. The lighting fixture 400 may be configured to produce a light output 490 towards an output direction 480. A top view of the lighting fixture 400 without the diffuser 465 is shown in FIG. 4B.

Figure 4B:
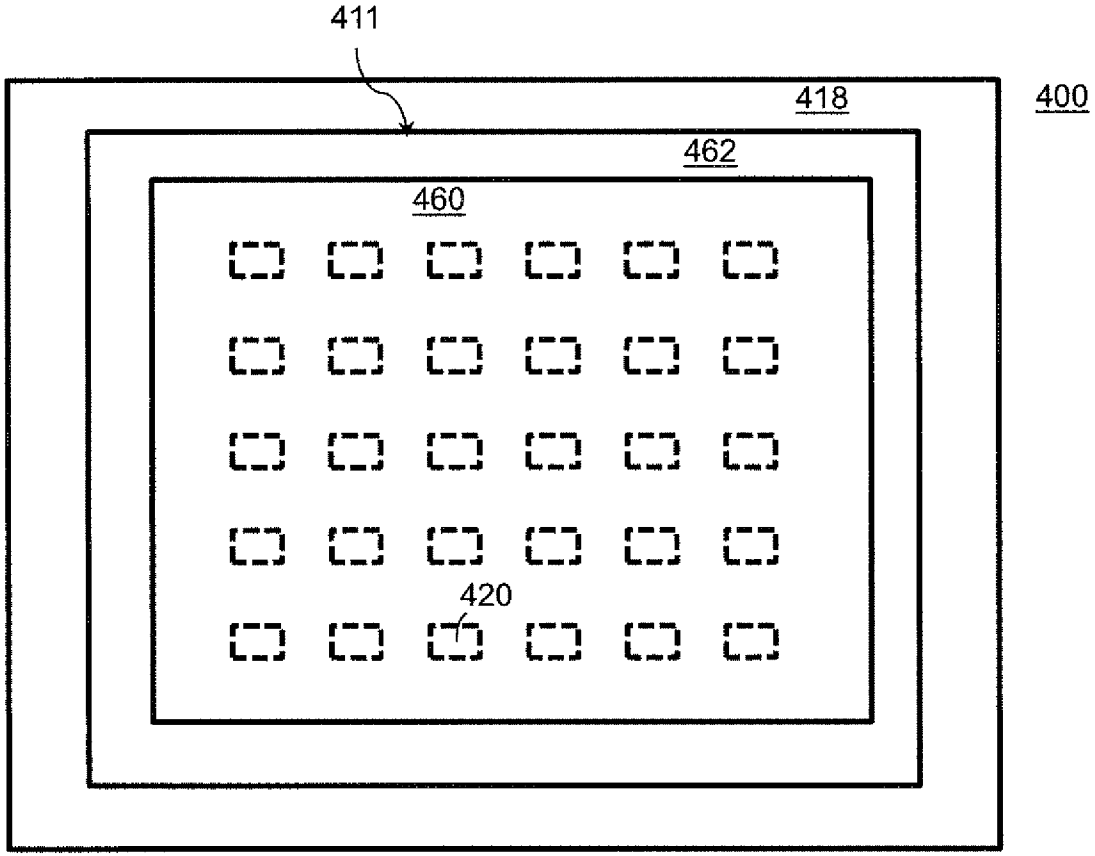
FIG. 4B illustrates a top view of the lighting fixture shown in FIG. 4A.

Although a plurality of light sources are shown in FIG. 4A and FIG. 4B, the lighting fixture 400 may comprise only one package light source 420 in another embodiment. The light source 420 and the circuit 470 may be attached to a substrate 410, which in turn being attached on a portion of the body 418. Alternatively, the light source 420 and the circuit 470 may be attached directly to the casing 418 or via two different PCBs (not shown). The body 418 may be a casing for housing all components of the lighting fixture 400. One side of the body 418 may comprise an aperture 411 for light output use. The aperture 411 may be arranged facing the output direction 480. A diffuser 465 may cover the aperture 411. Alternatively, instead of a diffuser 465, a substantially transparent cover (not shown) may be employed. A cavity 425 may be formed adjacent to the aperture 411 between the aperture 411 and the light source 420.

Similar to the previously disclosed embodiments, the light source 420 may be configured to emit light having a source wavelength band. The aperture 411 of the body 418 may be arranged approximating the light source 420 for allowing the light from the light source 420 to be transmitted towards the output direction 480 through the aperture 411. The first wavelength converter 460 may be configured to convert an amount of the light from the light source 420 entering the first wavelength converter 460 into a first converted light having a first wavelength band broader than the source wavelength band.

The first wavelength converter 460, in the embodiment shown in FIGS. 4A-4B may be the primary wavelength covering at least one substantial portion of the first aperture 411 such that light exiting the at least one substantial portion of first aperture 411 is transmitted through the first wavelength converter 460. In one embodiment, the light output 490 may comprise more than 60% of the light transmitted through the first wavelength converter 460 or the primary wavelength converter. The first transmission adjustor 430 may be optically coupled to the light source 420 so as to control the amount of light from the light source 420 entering the first wavelength converter 460. The first transmission adjustor 430 may be substantially similar to the transmission adjustor 130 shown in FIG. 1, or the first transmission attenuator 330 shown in FIG. 3A.

In addition, the second wavelength converter 462 may be configured to convert an additional amount of the light into a second converted light having a second wavelength band broader than the source wavelength band. The second wavelength converter 462 may be formed covering at least one additional portion of the first aperture 411 adjacent to the first wavelength converter 460. The second transmission adjustor 432 may be optically coupled to the light source 420 so as to control the additional amount of the light from the light source 420 entering the second wavelength converter 462. The second wavelength converter 462 shown in FIG. 4A may be a secondary wavelength converter 462 for adjusting color point of light output 490. The arrangement of the first wavelength converter 460 covering substantial portion and the second wavelength converter 462 covering a second smaller portion may be advantageous as the second wavelength converter 462 may be for color adjusting purpose.

As can be seen in FIG. 4A and FIG. 4B, the second wavelength converter 462 may be formed circumferencing the first wavelength converter 460. As shown in FIG. 4B, the first and second wavelength converters 460, 462 may be substantially coaxially aligned. The transmission adjustors 430, 432 may be optically coupled to the first and second wavelength converters 460, 462 respectively on the other side of the second transmission layer 442 approximating the first and second wavelength converters 460, 462. As shown in FIG. 4A, the first and second wavelength converters 460, 462, the seal 452 may be sandwiched between the first and second transmission layers 440,442.

In order to independently control the light transmission, the first and second transmission adjustors 430, 432 may be optically isolated using an isolator 450. However, the first and second wavelength converters 460, 462 may be placed adjacent to each other without an isolator 450. In one embodiment, the first and second wavelength converters 460, 462 may be a thin film layer forming on the second transmission layer 442 overlapping each other slightly near boundary area.

As discussed in the previous embodiment, the first and second wavelength converters 460, 462 may be slightly larger than the first and second transmission adjustors 430, 432 such that the light transmitted through the first and second wavelength converters 460, 462 may be transmitted through the first and second transmission adjustors 430, 432. As shown in FIG. 4A, the first and second wavelength converters 460, 462, the first and second transmission layers 440, 442 and the first and second transmission adjustors 430, 432 may be formed or arranged planarly orthogonal to the output direction 480 so as to intercept light emitted from the light source 420.

Figure 5A:
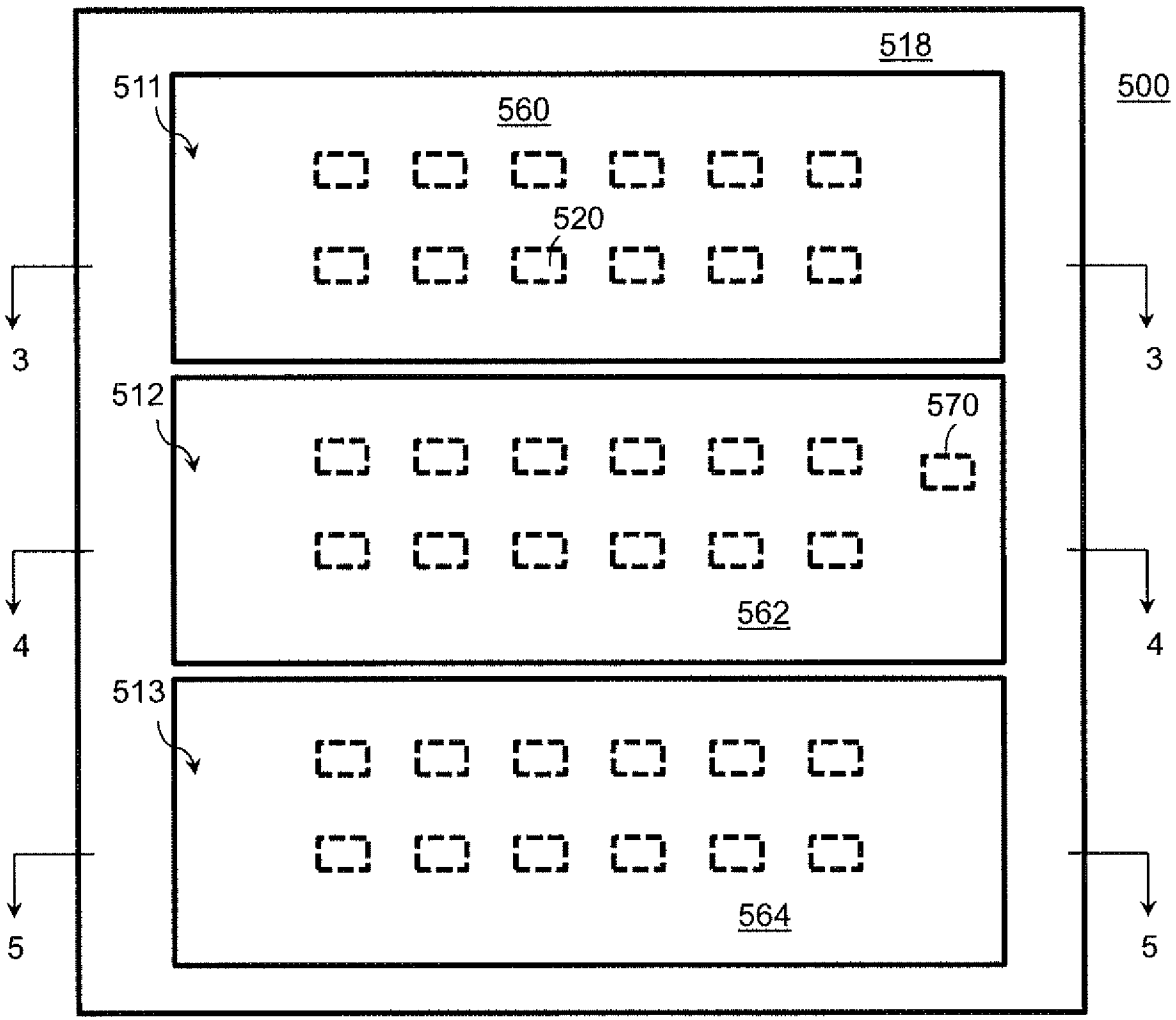
FIG. 5A illustrates a top view of a lighting fixture having a plurality of apertures and a plurality of wavelength converters.
Figure 5B:
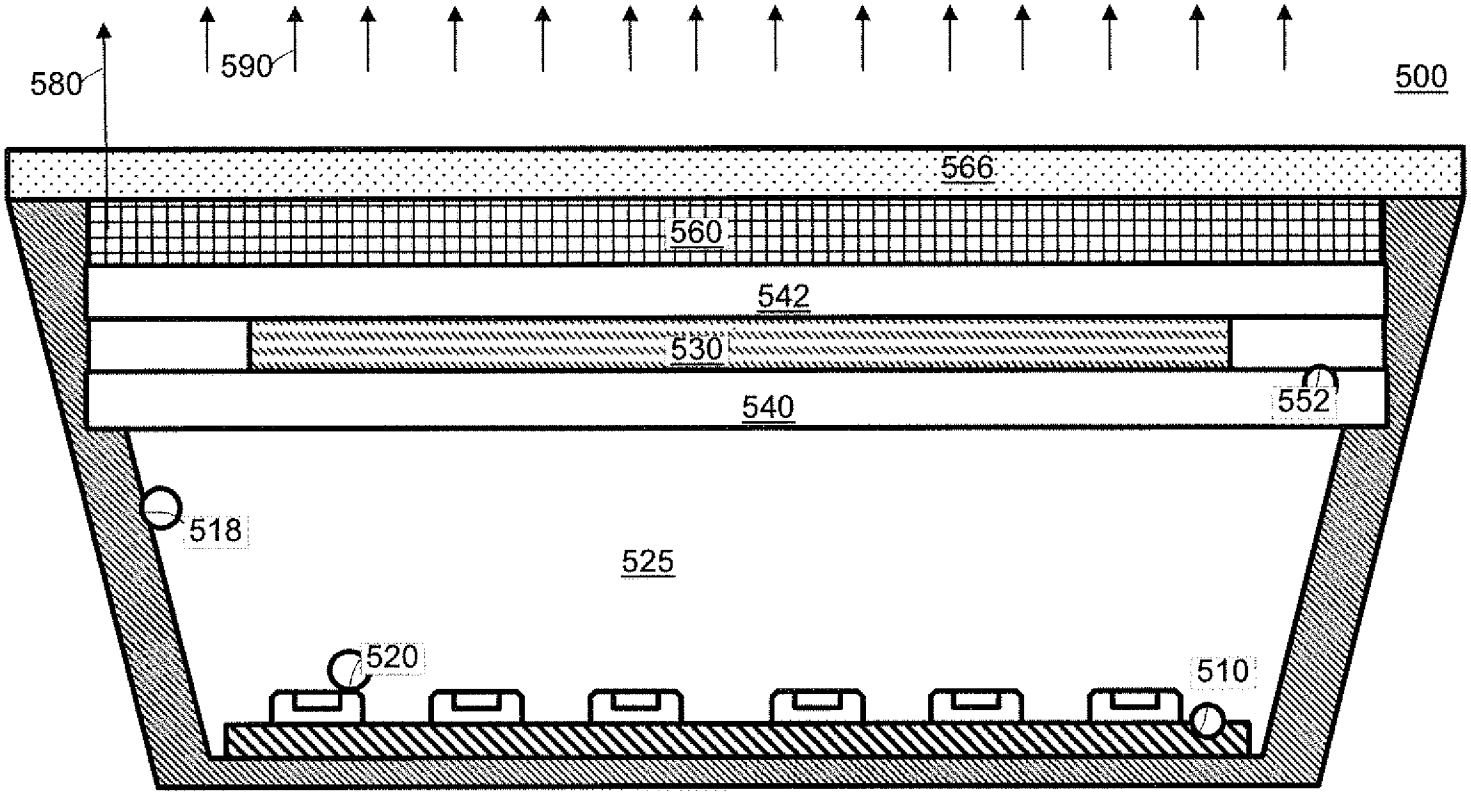
FIG. 5B illustrates a cross-sectional view of the lighting fixture shown in FIG. 5A taken along line 3-3.
Figure 5C:
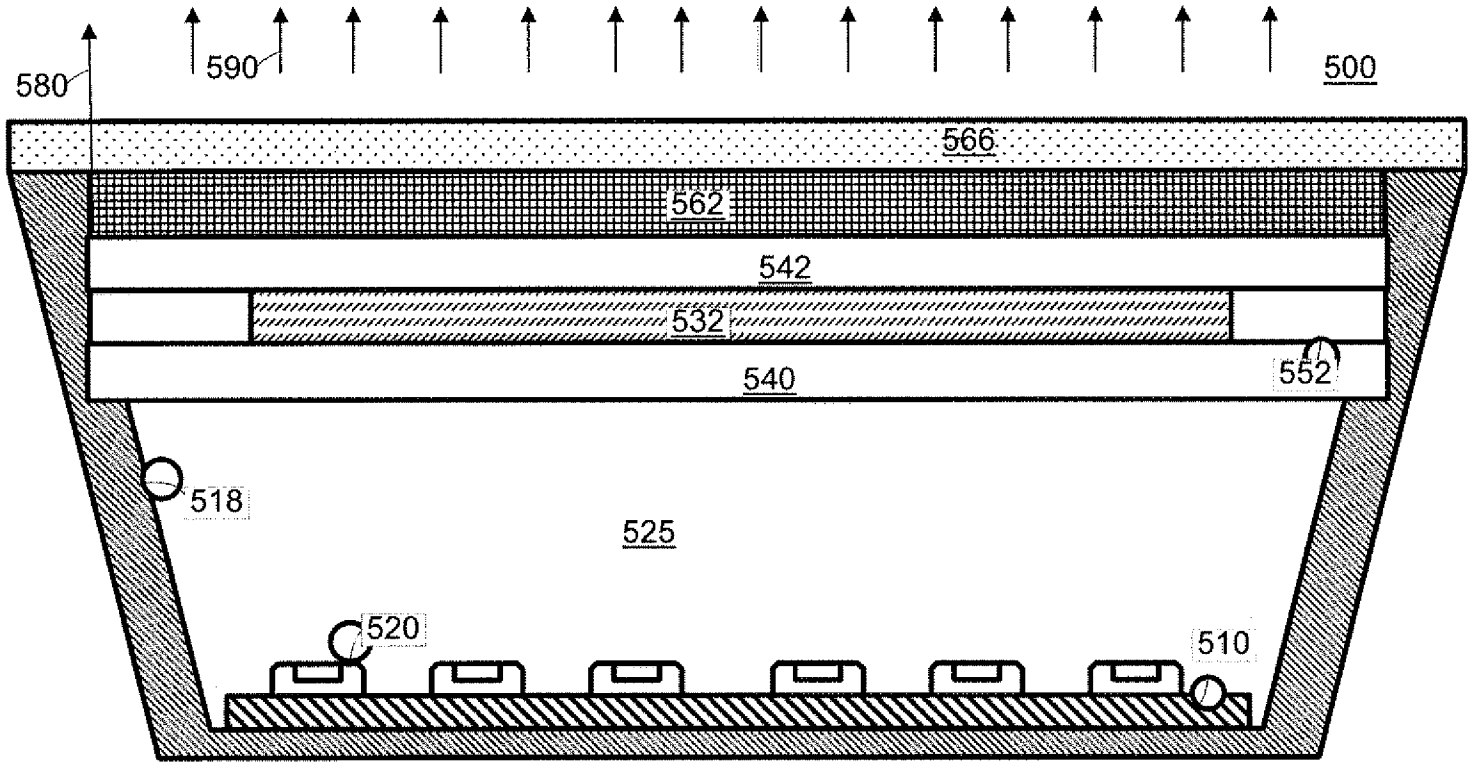
FIG. 5C illustrates a cross-sectional view of the lighting fixture shown in FIG. 5A taken along line 4-4.
Figure 5D:
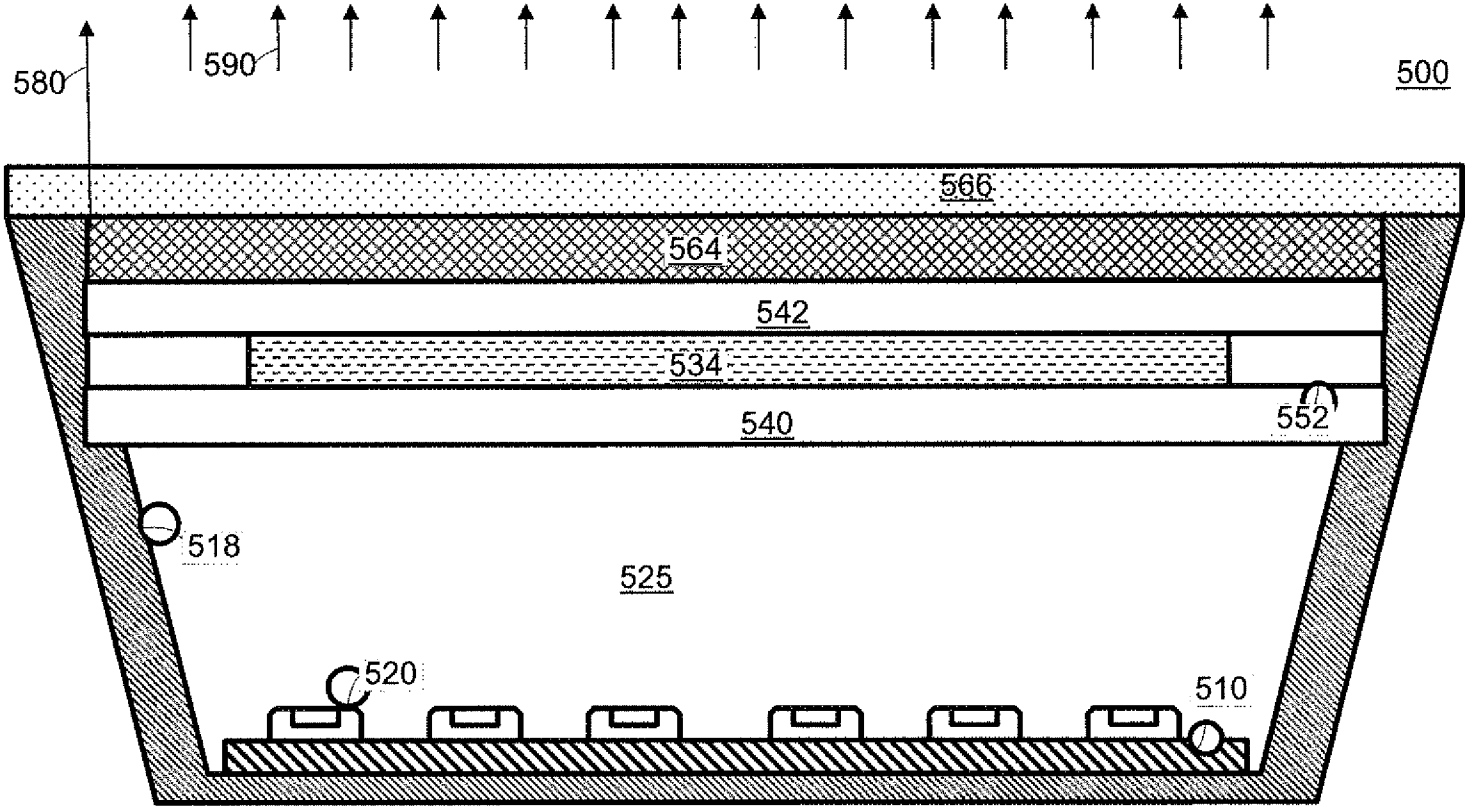
FIG. 5D illustrates a cross-sectional view of the lighting fixture shown in FIG. 5A taken along line 5-5.
Figure 6A:
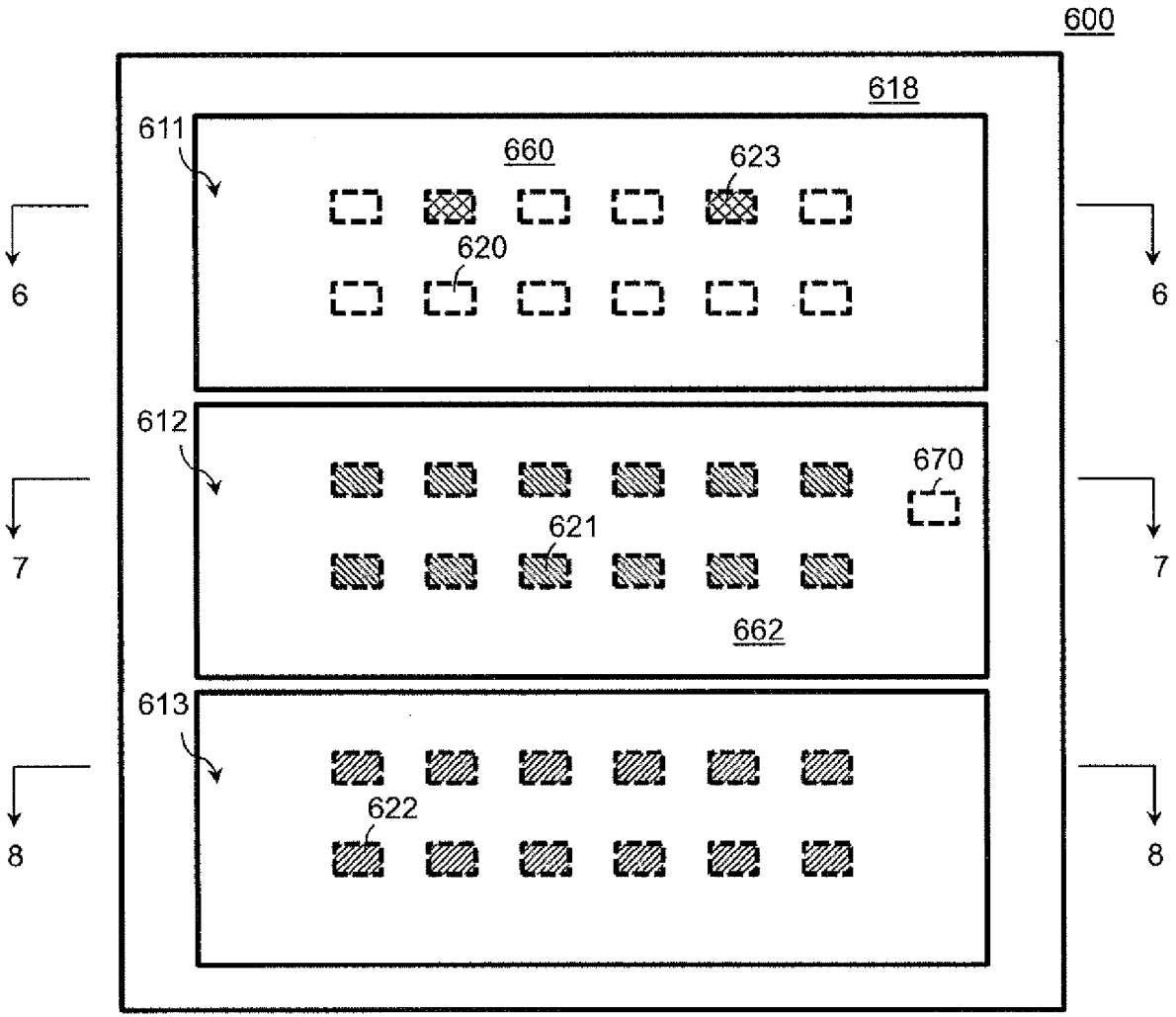
FIG. 6A illustrates a top view of a lighting fixture having at least one aperture not covered with a wavelength converter.
Figure 6B:
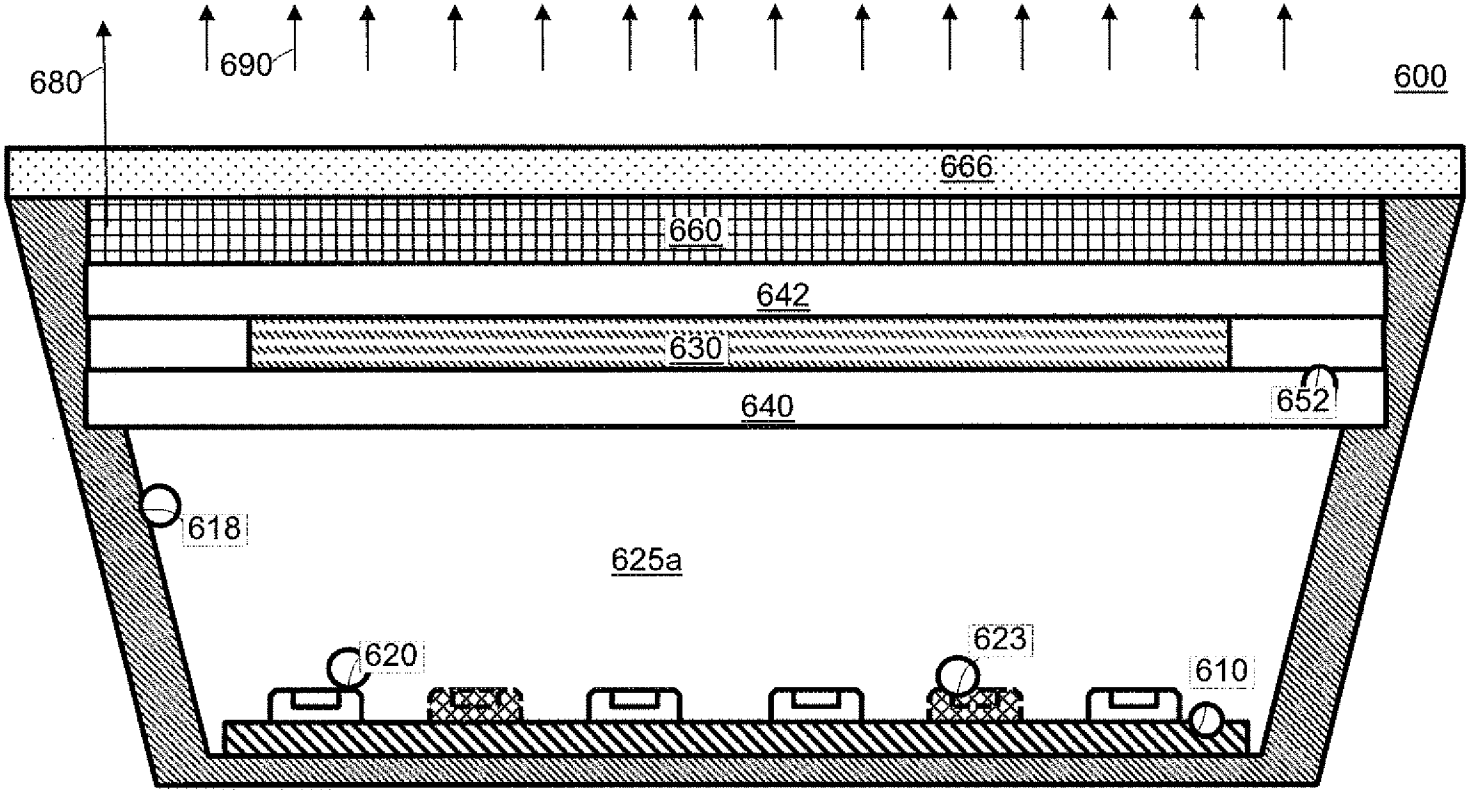
FIG. 6B illustrates a cross-sectional view of the lighting fixture shown in FIG. 6A taken along line 6-6.
Figure 6C:
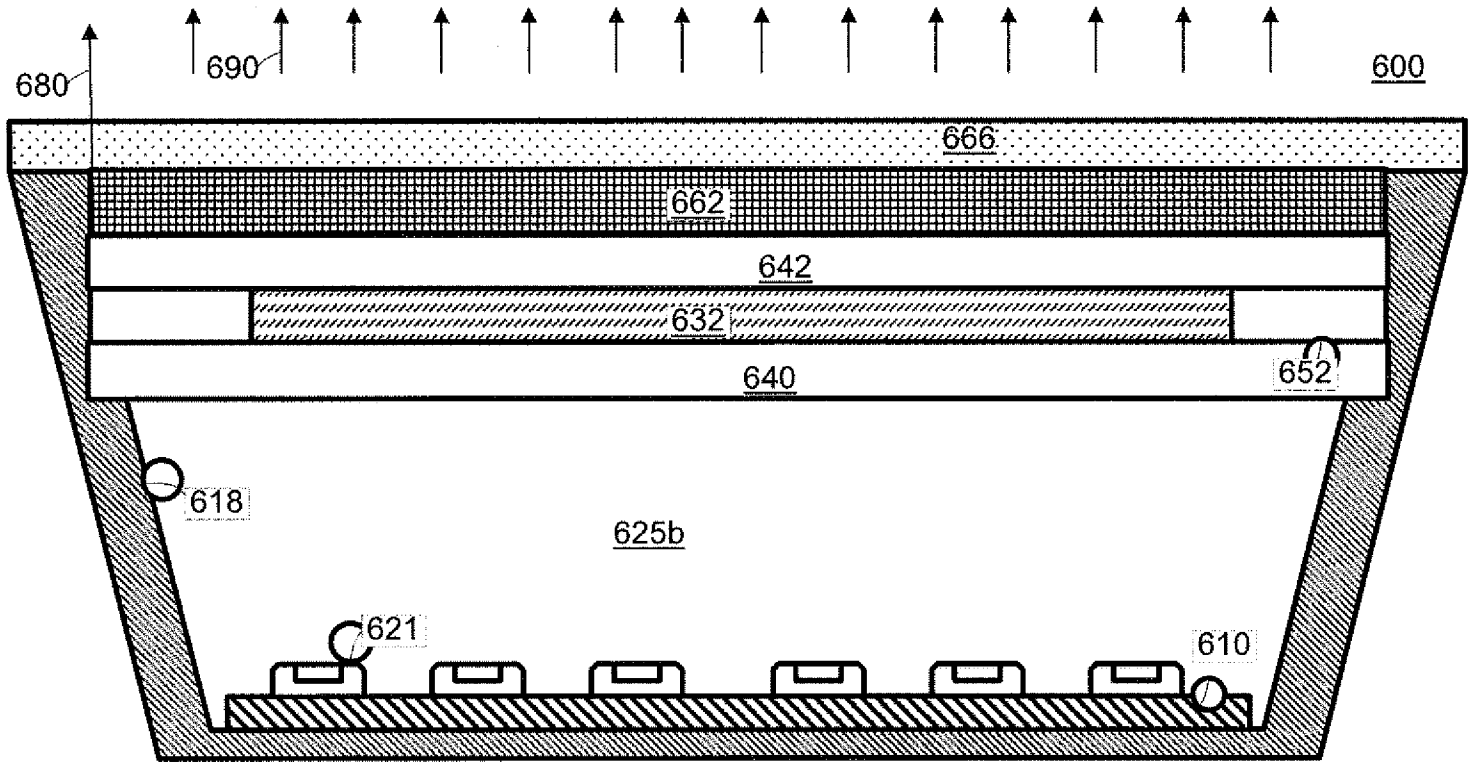
FIG. 6C illustrates a cross-sectional view of the lighting fixture shown in FIG. 6A taken along line 7-7.
Figure 6D:
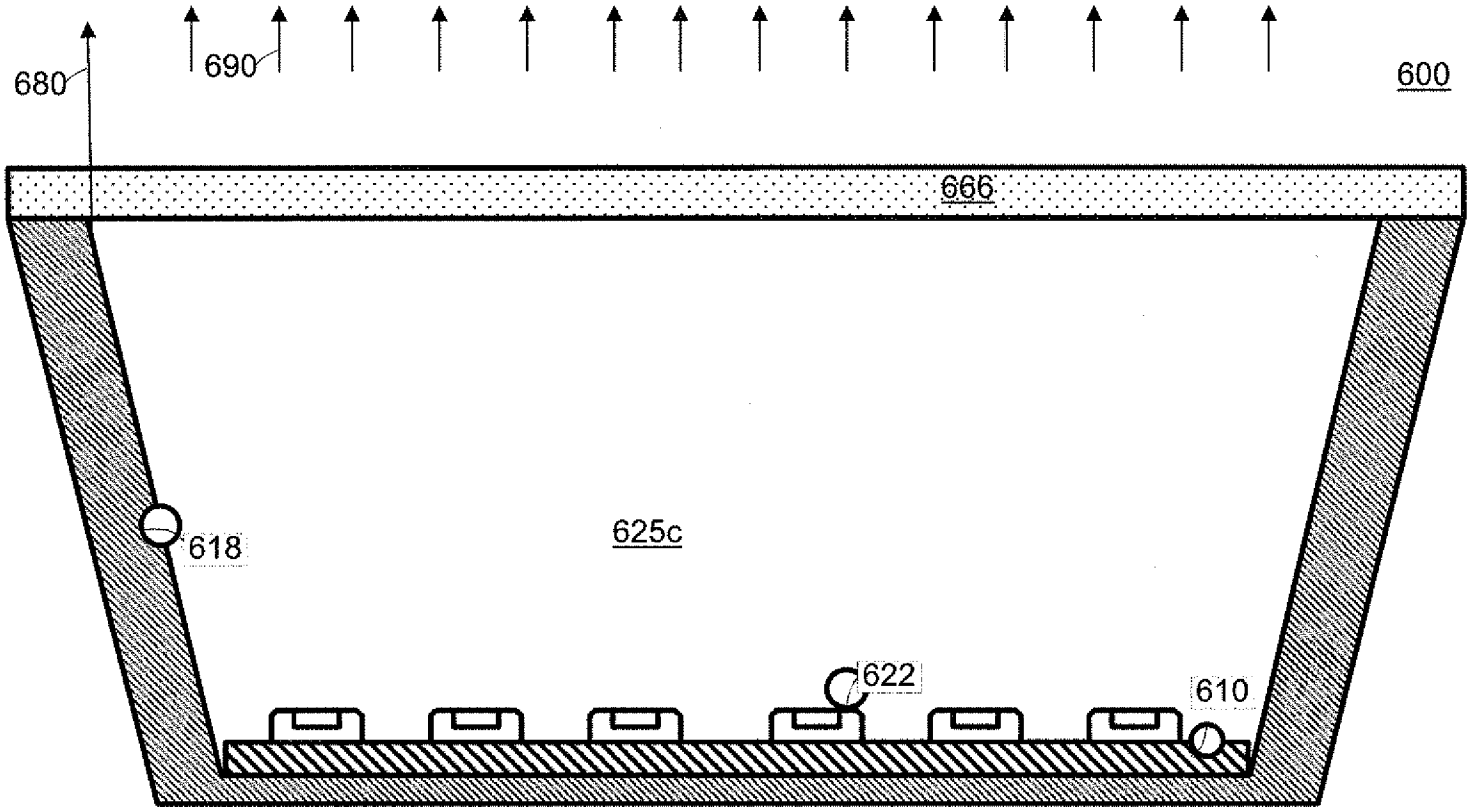
FIG. 6D illustrates a cross-sectional view of the lighting fixture shown in FIG. 6A taken along line 8-8.

FIG. 5A illustrates a top view of a lighting fixture 500 having a plurality of apertures 511-513. FIG. 5B illustrates a cross-sectional view of the lighting fixture 500 shown in FIG. 5A taken along line 3-3, whereas FIG. 5C and FIG. 5D illustrate a cross-sectional views of the lighting fixture 500 shown in FIG. 5A taken along line 4-4 and line 5-5 respectively. Referring to FIGS. 5A-5D, the lighting fixture 500 may comprise a body 518, an optional substrate 510, a light source 520, a first transmission layer 540, a second transmission layer 542, a first transmission adjustor 530, a second transmission adjustor 532, a third transmission adjustor 534, a seal 552, a first wavelength converter 560, a second wavelength converter 562, a third wavelength converter 564, a transparent cover 566 and a circuit 570. The lighting fixture 500 may be configured to produce a light output 590 towards an output direction 580. The top view shown in FIG. 5A may be with a transparent cover 566 but in other embodiment, the transparent cover 566 may comprise micro-optics to diffuse light.

The cavity 525 shown in FIGS. 5B-5D may be interconnected. The plurality of apertures 511-513 may be formed adjacent to the cavity 525 such that the cavity 525 may be sandwiched between the plurality of apertures 511-513 and the light source 520. The lighting fixture 500 may be substantially similar to the lighting fixture 400 but differs at least in that the lighting fixture 500 employs an arrangement scheme where one of the wavelength converters 560-564 may be disposed in one of the apertures 511-513. The cavity 525 may be configured to provide space for mixing light from the light source 520 prior to entering the transmission adjustor 530.

In addition, the first wavelength converter 560 may be configured to cover at least one substantial portion of the first aperture 511 such that light exiting the first aperture 511 is transmitted through the first wavelength converter 560. Similarly, the second wavelength converter 562 may be configured to cover at least one substantial portion of the second aperture 512 such that light exiting the second aperture 512 is transmitted through the second wavelength converter 562, whereas the third wavelength converter 564 may be configured to cover at least one substantial portion of the third aperture 513 such that light exiting the third aperture 513 is transmitted through the third wavelength converter 564.

Similar to the previous embodiment, each of the first, second and third wavelength converters 560, 562, 564 may be configured to convert a colored narrow band light from the light source 520 into a broader band light respectively. In one embodiment, the broader band light may be white light having different color points.

FIG. 6 illustrates a top view of a lighting fixture 600 with at least one aperture 613 not covered by a wavelength converter 660. FIG. 6B illustrates a cross-sectional view of the lighting fixture 600 shown in FIG. 6A taken along line 6-6, whereas FIG. 6C and FIG. 6D illustrate cross-sectional views of the lighting fixture 600 shown in FIG. 6A taken along line 7-7 and line 8-8 respectively. Referring to FIGS. 6A-6D, the lighting fixture 600 may comprise a body 618, an optional substrate 610, a plurality of light sources 620-622, a first transmission layer 640, a second transmission layer 642, a first transmission adjustor 630, a second transmission adjustor 632, a seal 652, a first wavelength converter 660, a second wavelength converter 662, a transparent cover 666 and a circuit 670. The lighting fixture 600 may be configured to produce a light output 690 towards an output direction 680.

The lighting fixture 600 may be substantially similar to the lighting fixture 600 shown in FIGS. 6A-6D but differs at least in that the lighting fixture 600 comprise two wavelength converters 660, 662 and having at least a light source 622 directly optically coupled to the transparent cover 666 so as to emit a light output 690 without going through wavelength conversion. In addition, each aperture 611-613 may be coupled to a different type of light source 620-622. For example, the first light source 620 may be arranged within a first cavity 625*a* approximating the first aperture 611, the second light source 621 may be arranged within a second cavity 625*b* approximating the second aperture 612 whereas the third light source 622 may be arranged within the third cavity 625*c* approximating the third aperture 613. The first, second and third cavity 625*a*-625*c* may be optically isolated by a portion of the body 618 that may be opaque.

Generally, the first and second light source 620, 621 may be configured to emit a colored narrow band light. However, the colored narrow band light may be converted into a broader wavelength band by the wavelength converter 660, 662 respectively. In the embodiment shown in FIG. 6, the first and second light source 620, 621 may be configured to emit a colored narrow band light that may be then converted into broad-spectrum white light. Optionally, one additional light source 623 may be arranged within the first cavity 625*a* so as to produce a light. The light from the additional light source 623 and the light from the first light source 620 may be mixed within the first cavity 625*a* prior to entering the first transmission adjustor 630.

However, the third light source 622 may comprise a red LED die, a green LED die and a blue LED die. Hence, the third light source 622 may be configured to emit white color right by having proportional amount of red, green and blue light. Alternatively, the red, green and blue component may be adjusted to produce light of any color. Each color component of the light may be narrow band light and not a broad-spectrum light. The brightness of the third light source 622 may be adjusted by adjusting the supply current. Optionally, a third transmission adjustor (not shown) may be formed intercepting the light exiting the third aperture 613 so as to control the amount of light being output through the third aperture 613.

Figure 7:
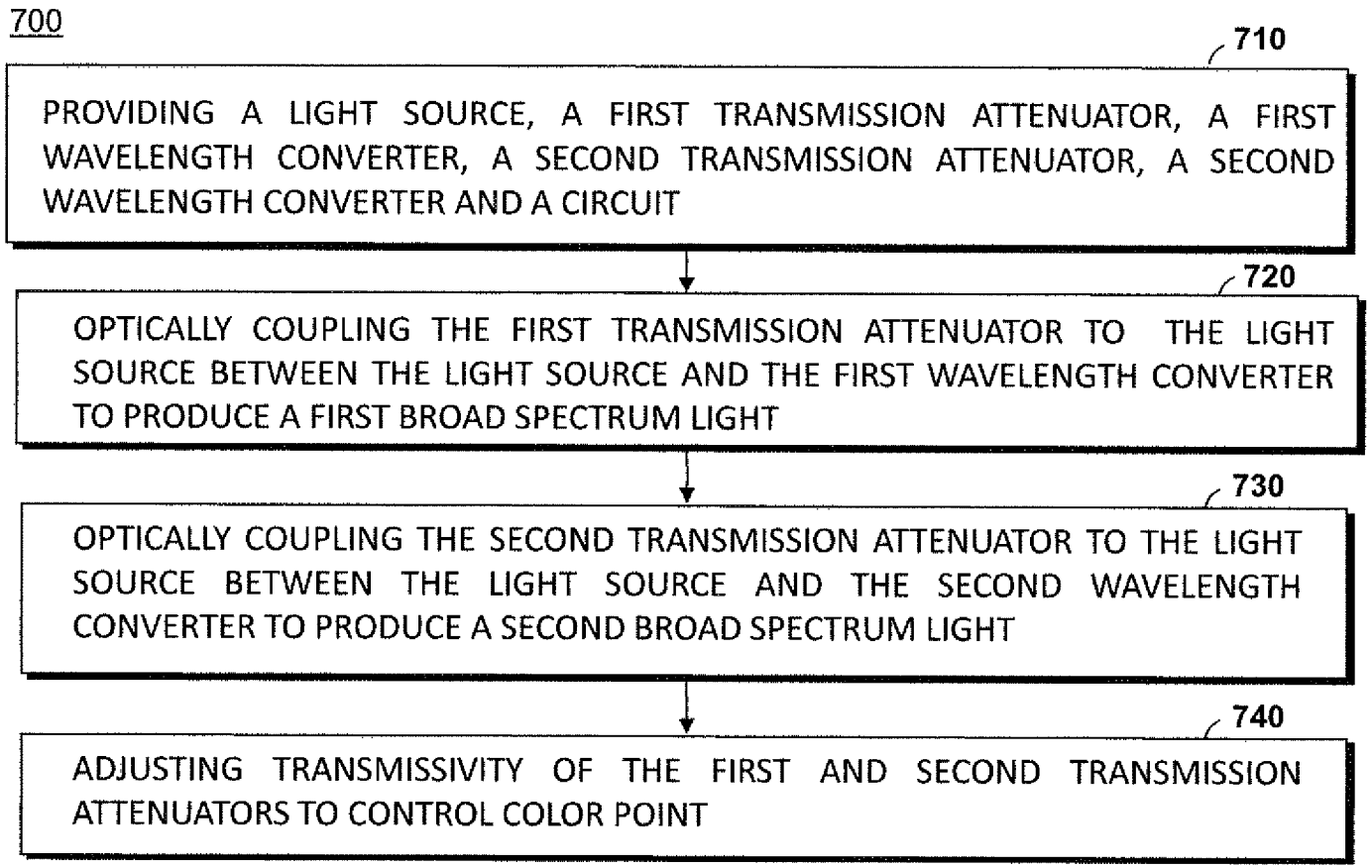
FIG. 7 illustrates a flow chart showing a method for controlling color point of a lighting apparatus.

FIG. 7 illustrates a flow chart 700 showing a method for controlling color point of a lighting apparatus. In step 710, a light source having a source wavelength band, a first transmission attenuator, a first wavelength converter, a second transmission attenuator, a second wavelength converter and a circuit is provided. The circuit may be electrically coupled to the first and second transmission attenuators. Next, in step 720, the first transmission attenuator may be optically coupled to the light source between the light source and the first wavelength converter to produce a first converted light having a first wavelength band broader than the source wavelength band.

Subsequently, in step 730, the second transmission attenuator may be optically coupled to the light source between the light source and the second wavelength converter to produce a second converted light having a second wavelength band broader than the source wavelength band. The method may then proceed to the step 740 in which transmissivity of the first and second transmission attenuators may be adjusted using the circuit to control color point of the lighting apparatus.

Different aspects, embodiments or implementations may, but need not, yield one or more of the following advantages. For example, the arrangement and the sizing chosen for the wavelength converters, the transmission adjustors and the transmission attenuators may be advantageous for enabling the control of light being converted by the wavelength converters. Another advantage may be that the amount and type of spectral converting material used may increase color-rendering index. Similarly, allowing colored narrow band light to form a portion of light output may increase color-rendering index.

Although specific embodiments of the invention have been described and illustrated herein above, the invention should not be limited to any specific forms or arrangements of parts so described and illustrated. For example, light source described above may be LEDs die or some other future light source die as known or later developed without departing from the spirit of the invention. Likewise, although a specific feature is discussed in each embodiment, the features described in one embodiment may be applicable to other embodiments. The scope of the invention is to be defined by the claims appended hereto and their equivalents.

What is claimed is:

1. A lighting apparatus for producing a light output, comprising:

a substrate;

a light source disposed on the substrate configured to emit a radiation having a source wavelength band;

a wavelength converter for converting an amount of the radiation from the light source entering the wavelength converter into a converted light that has a first wavelength band broader than the source wavelength band;

a transmission adjustor formed between the light source and the wavelength converter such that the radiation emitted from the light source entering the wavelength converter is substantially transmitted through the transmission adjustor, wherein the transmission adjustor has a transmissivity and the transmissivity is adjustable so as to control the amount of the radiation from the light source entering the wavelength converter, wherein the transmission adjustor is positioned between the first and second transmission layers;

a circuit configured to drive the light source and configured to generate an electrical signal indicative of the transmissivity of the transmission adjustor to the transmission adjustor; and a perimeter seal sandwiched between the first and second transmission layers circumferencing the transmission adjustor, and wherein the transmission adjustor is substantially sealed between the perimeter seal, the first and second transmission layers.

2. The lighting apparatus of claim 1, wherein the light source and the wavelength converter are arranged such that a portion of the radiation emitted from the light source is transmitted externally without being transmitted through the wavelength converter.

3. The lighting apparatus of claim 1, wherein the transmission adjustor is sandwiched between first and second transmission layers.

4. The lighting apparatus of claim 1, wherein the transmission adjustor is formed within a single integrated cavity that is formed between the perimeter seal, the first and second transmission layers.

5. The lighting apparatus of claim 4, wherein the first transmission layer comprises a substantially flat internal surface and wherein more than approximately eighty percent of the substantially flat internal surface is in direct contact with the single integrated cavity.

6. The lighting apparatus of claim 1, wherein:

the lighting apparatus has an output direction;

the wavelength converter has a converter surface arranged substantially orthogonal relative to the output direction; and the transmission adjustor has an adjustor surface arranged substantially orthogonal relative to the output direction.

7. The lighting apparatus of claim 6, wherein the converter surface is approximately equal to or smaller than the adjustor surface.

8. The lighting apparatus of claim 1, wherein the circuit is configured to control the transmission adjustor such that the electrical signal of the circuit is linearly proportional to the transmissivity of the transmission adjustor.

9. The lighting apparatus of claim 1, wherein the transmission adjustor comprises an electro-chromic gel material.

10. A lighting apparatus for producing a light output, comprising:

a light source configured to emit light having a source wavelength band;

a first wavelength converter configured to convert the light into a first converted light having a first wavelength band broader than the source wavelength band;

a second wavelength converter configured to convert the light into a second converted light having a second wavelength band broader than the source wavelength band;

a first transmission attenuator optically coupled to the light source to control a first amount of the light from the light source entering the first wavelength converter; and a second transmission attenuator optically coupled to the light source to control a second amount of light from the light source entering the second wavelength converter.

11. The lighting apparatus of claim 10, further comprising a circuit electrically coupled to the first and second transmission attenuators.

12. The lighting apparatus of claim 11, wherein the circuit is configured to adjust color point of the light output by adjusting the first and second amount of light passing through the first and second transmission attenuators respectively.

13. The lighting apparatus of claim 10 further comprising an isolator substantially isolating the first and second transmission attenuators.

14. The lighting apparatus of claim 10 further comprising:

first and second transmission layers interposing the first and second transmission attenuators;

a seal circumferencing the first and second transmission attenuators such that the first and second transmission attenuators are substantially sealed between the seal, the first and second transmission layers.

15. The lighting apparatus of claim 10 further comprising: a first attenuator control circuit electrically coupled to the first transmission attenuator to control transmissivity of the first transmission attenuator; and a second attenuator control circuit electrically coupled to the second transmission attenuator to control transmissivity of the second transmission attenuator.

16. A lighting fixture for generating light output towards an output direction,comprising:

a body;

a light source configured to emit light having a source wavelength band;

a first aperture of the body arranged approximating the light source allowing the light from the light source to be transmitted towards the output direction through the first aperture;

a first wavelength converter configured to convert an amount of the light from the light source entering the first wavelength converter into a first converted light having a first wavelength band broader than the source wavelength band, the first wavelength converter configured to cover at least one substantial portion of the first aperture such that light exiting the at least one substantial portion of first aperture is transmitted through the first wavelength converter; and a first transmission adjustor optically coupled to the light source so as to control the amount of light from the light source entering the first wavelength converter, wherein the first transmission adjustor blocks the light emitted by the light source when a first state and allows the light emitted by the light source to pass therethrough in a second state.

17. The lighting fixture of claim 16 further comprising:

a second wavelength converter configured to convert an additional amount of the light into a second converted light having a second wavelength band broader than the source wavelength band; and a second transmission adjustor optically coupled to the light source so as to control the additional amount of the light from the light source entering the second wavelength converter, wherein the second transmission adjustor blocks the light emitted by the light source when in a first state and allow the light emitted by the light source to pass therethrough in a second state.

18. The lighting fixture of claim 17, wherein the second wavelength converter is formed covering at least one additional portion of the first aperture adjacent to the first wavelength converter.

19. The lighting fixture of claim 17 further comprising a second aperture,wherein the second wavelength converter is configured to cover at least one substantial portion of the second aperture such that light exiting the second aperture is transmitted through the second wavelength converter.

20. The lighting fixture of claim 16, further comprising a circuit electrically coupled to the first transmission adjuster so as to switch the first transmission adjuster between the first and second state.

* * * * *